US007988544B2

(12) United States Patent
Vanden Bosch et al.

(10) Patent No.: US 7,988,544 B2
(45) Date of Patent: Aug. 2, 2011

(54) BIRD/ANIMAL RESTRICTING VENT FOR FLUID/AIR DISCHARGE CONDUITS

(75) Inventors: Kalvin K Vanden Bosch, West Olive, MI (US); Brian R Dykstra, Zeeland, MI (US)

(73) Assignee: P-tec Products, Inc., Zeeland, MI (US)

( * ) Notice: Subject to any disclaimer, the term of this patent is extended or adjusted under 35 U.S.C. 154(b) by 1062 days.

(21) Appl. No.: 11/477,845

(22) Filed: Jun. 29, 2006

(65) Prior Publication Data

US 2007/0010191 A1 Jan. 11, 2007

Related U.S. Application Data

(60) Provisional application No. 60/697,127, filed on Jul. 7, 2005.

(51) Int. Cl.
*F24F 13/20* (2006.01)
*F24F 7/00* (2006.01)

(52) U.S. Cl. ..... 454/367; 454/359

(58) Field of Classification Search ..... 454/367
See application file for complete search history.

(56) References Cited

U.S. PATENT DOCUMENTS 2,770,833 A * 11/1956 Drechsel ..... 16/255
3,171,343 A 3/1965 Wexler
3,842,722 A 10/1974 Miller
4,151,789 A 5/1979 Grobard
4,334,461 A 6/1982 Ferguson et al.
5,046,408 A 9/1991 Eugenio
5,722,181 A 3/1998 Meyer
5,916,023 A 6/1999 Meyer
6,302,788 B1 10/2001 Gagnon
6,361,433 B1 3/2002 Gray
6,682,415 B1 1/2004 Vagedes

* cited by examiner

*Primary Examiner* — Steve McAllister
*Assistant Examiner* — Kosanovic Helena
(74) *Attorney, Agent, or Firm* — Van Dyke, Gardner, Linn & Burkhart, LLP

(57) ABSTRACT

A vent assembly for attachment to a fluid discharge conduit of the type connected to a clothes dryer, room exhaust fan, or the like includes a mount having an opening received on the conduit and a door pivotally received by the mount. The door includes a first surface portion for covering at least a portion of the opening and a second surface portion joined to the first surface portion and extending from the door and protruding into the opening. The door is operable for displacement with respect to the opening between an open position and a closed position when engaged by a fluid flowing through the discharge conduit. The door is in the open position only after the door pivots sufficiently to move the first and second surface portions fully out of the opening, whereby birds, animals, and the like are restricted from entering the conduit.

23 Claims, 21 Drawing Sheets

BIRD/ANIMAL RESTRICTING VENT FOR FLUID/AIR DISCHARGE CONDUITS

CROSS-REFERENCE TO RELATED APPLICATION

This application claims priority on U.S. provisional patent application Ser. No. 60/697,127, filed Jul 7, 2005, which is hereby incorporated by reference herein.

BACKGROUND OF THE INVENTION

The present invention relates in general to venting and conduit devices for routing fluid/air exhaust, such as from a clothes dryer or the like, from within a structure to a remote location outside of the structure. The exhaust from a clothes dryer, a bathroom fan, a kitchen fan or similar device is typically routed to the outside atmosphere by means of some type of conduit and vent. The exit location from the corresponding structure is typically an outside wall of the structure. The conduit is secured to the exhaust conduit of the clothes dryer, bathroom fan, or kitchen fan and then routed to the exit location. At the exit location a flow opening or passageway is created in the structure wall and a suitable vent is mounted into, onto, or across the exit flow opening. In order to substantially prevent the inflow or backflow of outside air, as well as to prevent the entry of moisture which may result from rain or snow, conventional exhaust vents may be covered with a hood and may include a one-way or hinged flapper or a series of hinged louvers secured within a surrounding frame.

One of the problems with conventional vents, such as louvers or flappers, is that external vent hoods and even the conduit itself open out into the atmosphere and create a protected, warm location for birds and small animals to nest. The building of a nest in this area can prevent the conduit, flappers or louvers from freely opening in response to exiting exhaust air from the clothes dryer or similar device. Such an obstruction caused by the nest and/or birds or animals may interfere with the operation of the clothes dryer, cause damage to the clothes dryer, and could even create a risk of fire. Additionally, conventional clothes dryers will not provide any heat when such an obstruction causes limited or diminished air flow to the dryer. Even if the flapper or louvers are operable, an open and unguarded conduit provides an entrance path into the structure for birds and small animals. Moreover, birds and small animals are often able to open the flappers or louvers to gain entry into the conduit.

Some conventional systems utilize grid-like guards to cover either the conduit opening or hood opening to prevent entry of birds and small animals. However, these conventional grid-like guard systems require constant monitoring to prevent build up of lint exiting the clothes dryer through the conduit, and require frequent and repeated cleanings to clear the passageways. If the screen or grid is not cleaned or cleared, the blockage of air flow may interfere with the operation of the clothes dryer or other device.

Additionally, conventional systems also experience issues with chattering or vibration from vents during operation.

Therefore, there is a need for an improvement to conventional dryer exhaust vent design so that birds and small animals cannot nest inside the hood or gain access to the area adjacent to the vent flapper or vent louvers around the conduit.

There is a further need for unrestricted, free flow of exhaust from the clothes dryer while still providing a suitable barrier to the entry of birds and small animals and a suitable barrier to the nesting of birds and small animals without requiring repeated inspection and maintenance to ensure unrestricted free flow of exhaust.

SUMMARY OF THE INVENTION

The present invention provides a vent assembly for a discharge conduit which, when installed on the conduit, provides a venting system that mitigates the above-discussed difficulties. The vent assembly of the present invention provides a door with a surface portion that requires the door to be sufficiently moved out of the opening, whereby birds and other wildlife are restricted from entering the conduit. The vent assembly of the present invention eliminates the need for continuous and repeated monitoring of the discharge conduit for any build up of materials and the like.

According to one aspect of the present invention, a vent assembly for attachment to a fluid discharge conduit includes a mount having an opening received on the conduit and a door pivotally received by the mount. The door includes a first surface portion for covering at least a portion of the opening and a second surface portion joined to the first surface portion, extending from the door and protruding into the opening. The door is operable for displacement with respect to the opening between an open position and a closed position when the door is engaged by a fluid flowing through the discharge conduit. The door is in the open position only after the door pivots sufficiently to move the second surface portion fully out of the opening, whereby birds, animals, and the like are restricted from entering the conduit.

According to another aspect of the present invention, the first and second surface portions form a wedge-like shape. The first surface portion includes a planar plate. The second surface portion includes a conical wall forming a base of the wedge-like shape. The base is located opposite the position at which the door is pivotally received by the mount.

According to another form of the present invention, the first and second surface portions form a recessed cavity in the door.

In another form of the present invention, the door further includes a lip extending from the edge of the door and engaging the opening in the close position. The opening includes a rim surface protruding from the mount to receive the conduit. The rim surface receives and engages the door in the closed position. The lip rests substantially flush on the rim surface. The first and second surface portions extend into the opening when the door is in the closed position.

In another form of the present invention, the door includes a weight to help keep the door in the closed position when there is no fluid discharge from the conduit.

According to yet another form of the present invention, the vent assembly further includes a hood received by the mount. The mount includes a plurality of spaced flanges operable for removably receiving an edge of the hood.

In another form of the present invention, a venting system is provided. The venting system includes a discharge conduit connectable to an air exhaust outlet with an open end, a mount having an opening received by the discharge conduit, and a door pivotally received by the mount. The door includes a first surface portion for covering at least a portion of the opening and a second surface portion extending from the door and protruding into the opening. The door is operable for displacement with respect to the opening between an open position and a closed position when the door is engaged by a fluid flowing through the discharge conduit. The door is in the open position only after the door pivots sufficiently to move the first and second surface portions fully out of the opening, whereby birds, animals, and the like are restricted from entering the conduit.

In yet another form of the present invention, a vent for attachment to a fluid discharge conduit is provided. The vent includes a mount having a rim surface opening received on the conduit and a recessed, wedge-shaped door pivotally received by the mount. The door includes a first surface portion for covering at least a portion of the opening and a second surface portion extending from the door, joined to the first portion, and protruding into the opening. The door is operable for displacement with respect to the opening between an open position and a closed position when the first surface portion is engaged by a fluid flowing through the discharge conduit. The door is in the open position only after the door pivots sufficiently to move the second surface portion fully out of the opening, whereby birds, animals, and the like are restricted from entering the conduit.

In another form of the present invention, a first surface of a door is offset from the plane of a lip surface at an angle between 15° and 50° to form a wedge-like shape with a second surface. The door is operable for displacement with respect to an opening between an open position and a closed position when the door is engaged by fluid flowing through a discharge conduit. The door is in the open position only after the door pivots sufficiently to move the first and second surface portions fully out of the opening, whereby birds, animals, and the like are restricted from entering the conduit.

In another form of the present invention, first and the second surface portions of a door cover an opening in the range of between 50% and 99% of the area of the opening through a range of motion of the door from 0° and 50° relative to the plane of the opening. The door is operable for displacement with respect to the opening between an open position and a closed position when the door is engaged by fluid flowing through a discharge conduit. The door is in the open position only after the door pivots sufficiently to move the first and second surface portions fully out of the opening, whereby birds, animals, and the like are restricted from entering the conduit, until after the door is in an open position.

In another form of the present invention, first and the second surface portions of a door project inwardly of an opening to a position further inward with respect to a conduit than the position of hinges when a lip engages a rim. The door is operable for displacement with respect to the opening between an open position and a closed position when the door is engaged by fluid flowing through the discharge conduit. The door is in the open position only after the door pivots sufficiently to move the first and second surface portions fully out of the opening, whereby birds, animals, and the like are restricted from entering the conduit.

In yet another form of the present invention, a door is operable for displacement with respect to the opening between an open position and a closed position when the door is engaged by fluid flowing through the discharge conduit. The door has a maximum thickness defined by the height of a second surface portion of the door whereby birds, animals, and the like are deterred from entering the conduit. The door is in the open position when the door pivots sufficiently to move the first and second surface portions fully out of the opening.

Therefore, the present invention provides a vent assembly for attachment to a fluid/air discharge conduit. The vent assembly includes a door with a first surface portion, a second surface portion, and a lip surface for effectively closing an open end of the discharge conduit and freely opening to allow exhaust air/fluid from the discharge conduit. The first and second surface portions extend from the door and protrude into the open end of the discharge conduit. The first and second surface portions of the door must be moved completely out of the open end of the discharge conduit to place the door in an open position, thereby restricting entry of a bird or small animal into the discharge conduit. The vent assembly also reduces the build up of lint and other matter that may collect in passageways of the discharge conduit and interfere with operations of the dryer or other similar devices. The vent assembly freely discharges lint and other matter from the discharge conduit to reduce the need for continuous and repeated monitoring of the discharge conduit for any build up of lint or the like.

These and other objects, advantages, purposes, and features of the present invention will become apparent upon review of the specification in conjunction with the drawings.

DETAILED DESCRIPTION OF PREFERRED EMBODIMENTS

Figure 1A:
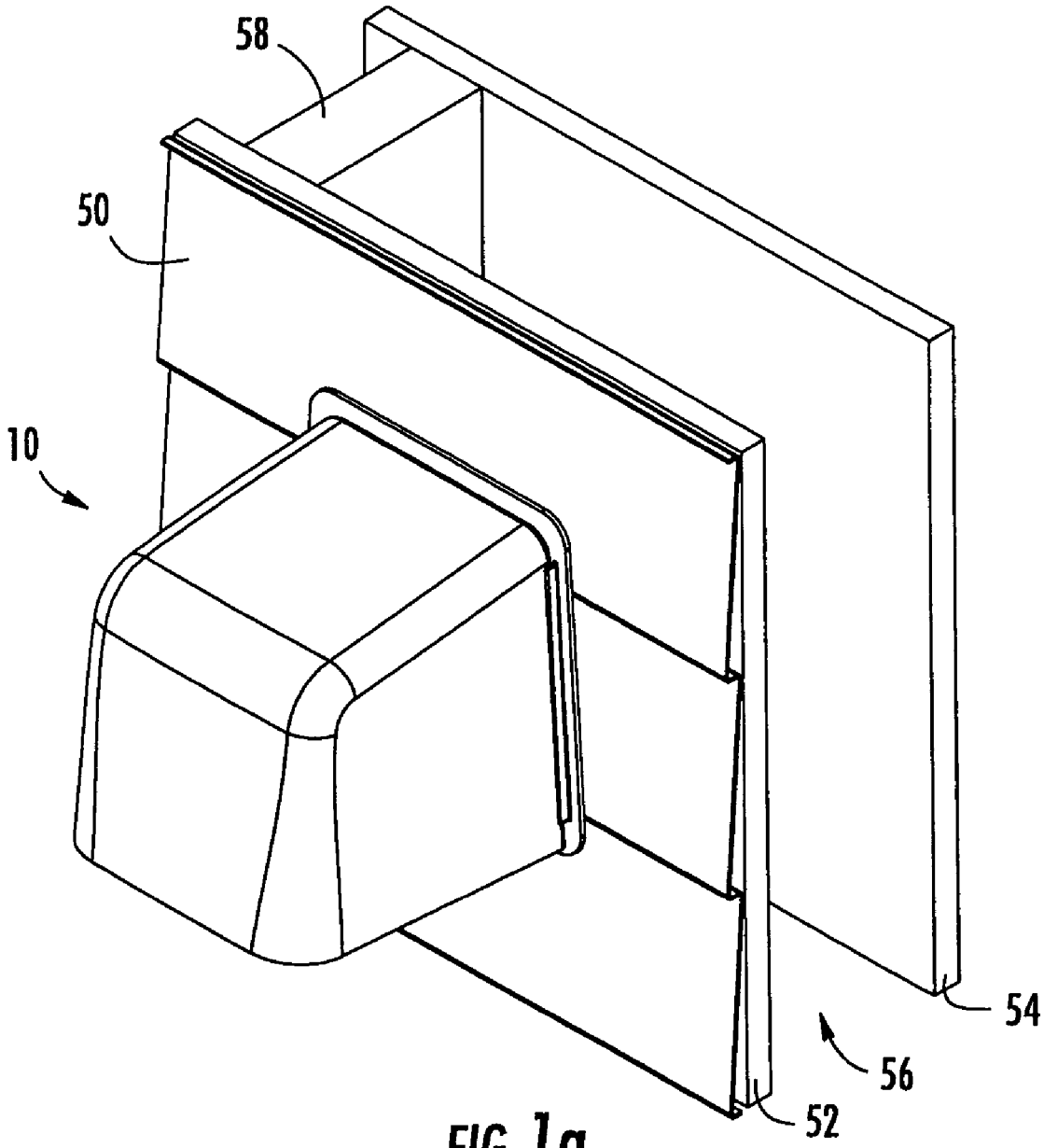
FIG. 1*a* is a top perspective view of the bird and small animal proof dryer vent assembly with a hood in accordance with the present invention.
Figure 1B:
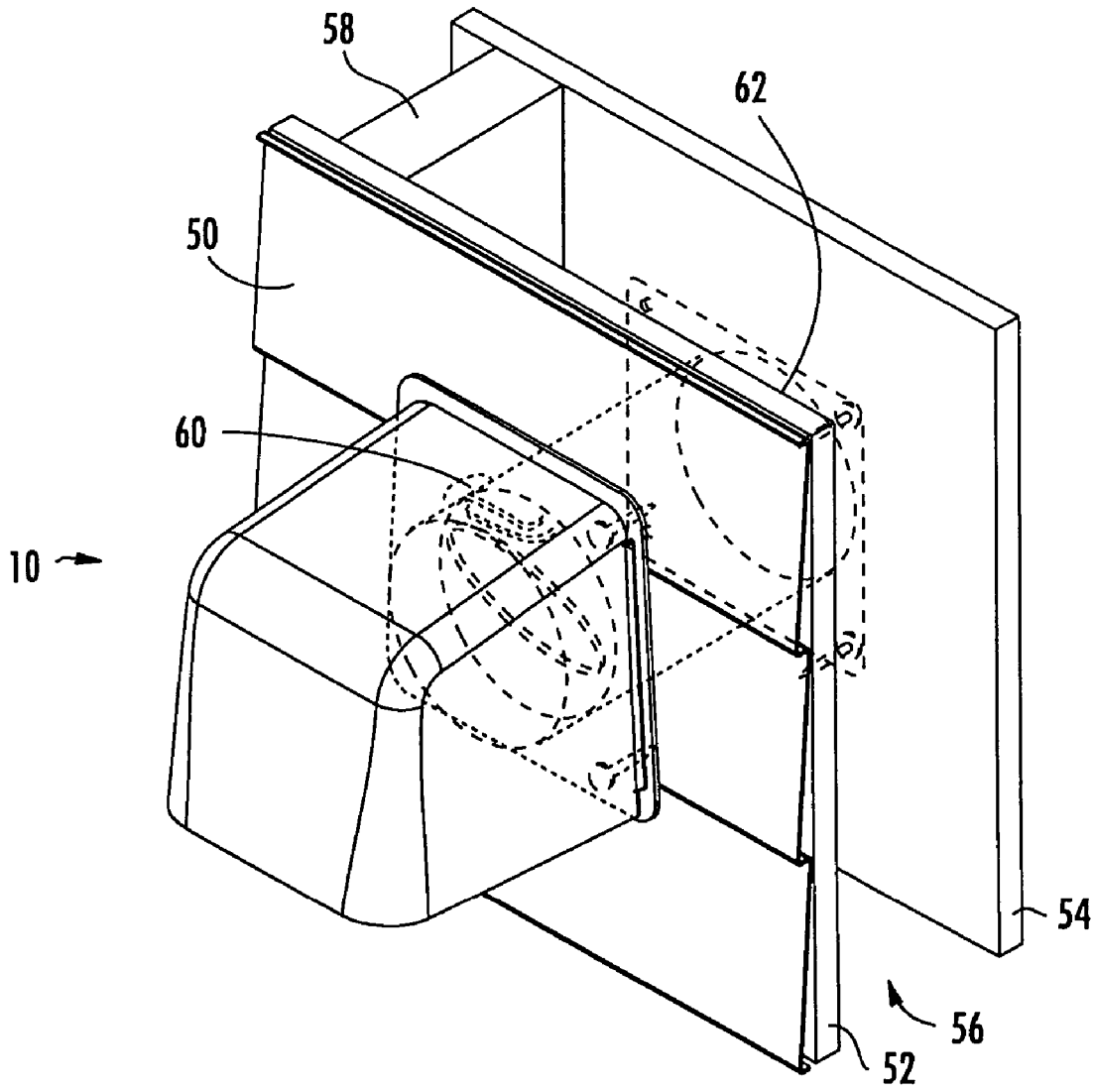
FIG. 1*b* is the vent of FIG. 1*a* with phantom lines showing components of the vent assembly.
Figure 1C:
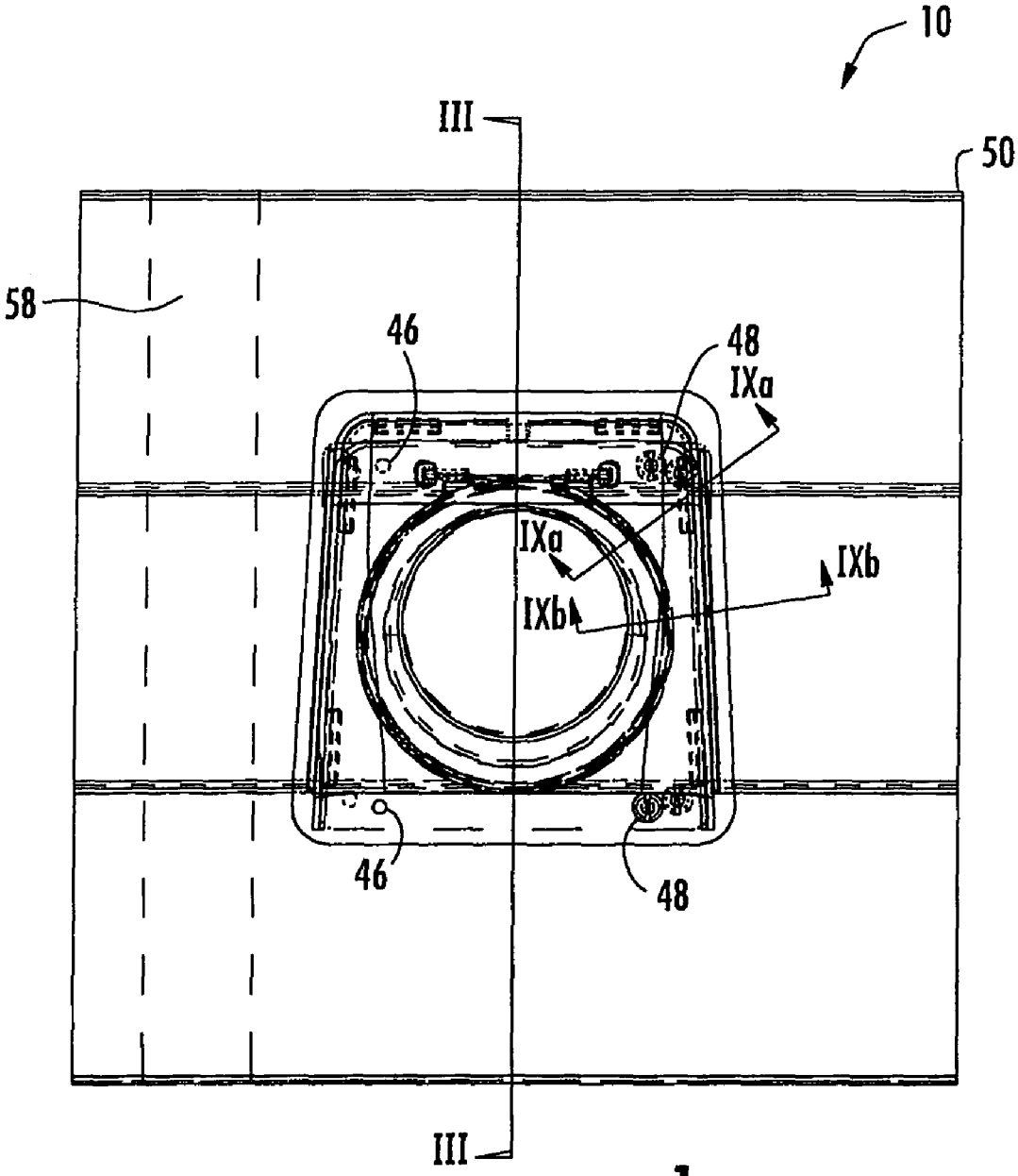
FIG. 1*c* is a front view of the vent of FIG. 1*a* with phantom lines showing components of the vent assembly.
Figure 1D:
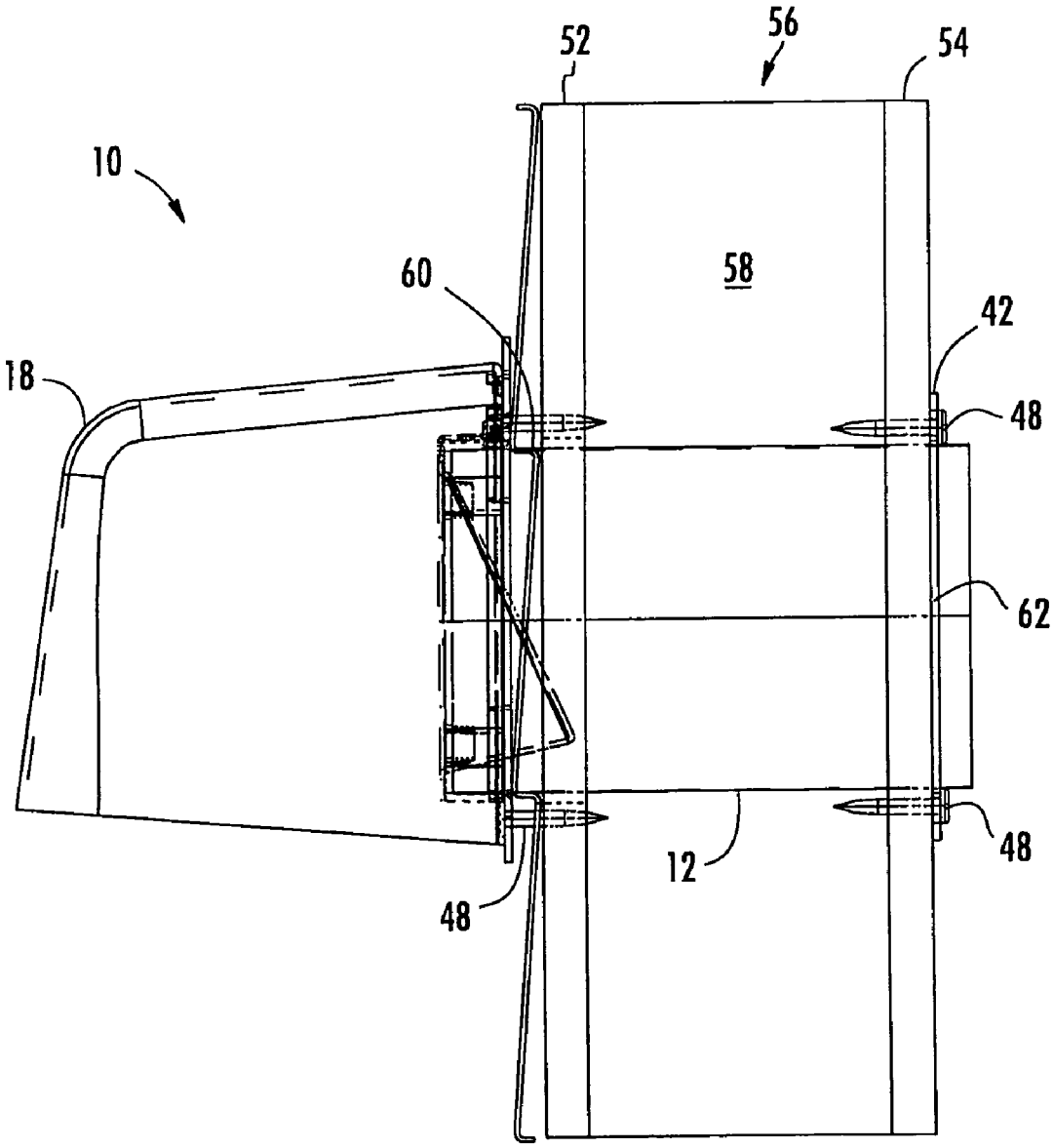
FIG. 1*d* is a side view of the vent assembly of FIG. 1*a* with phantom lines showing components.
Figure 1E:
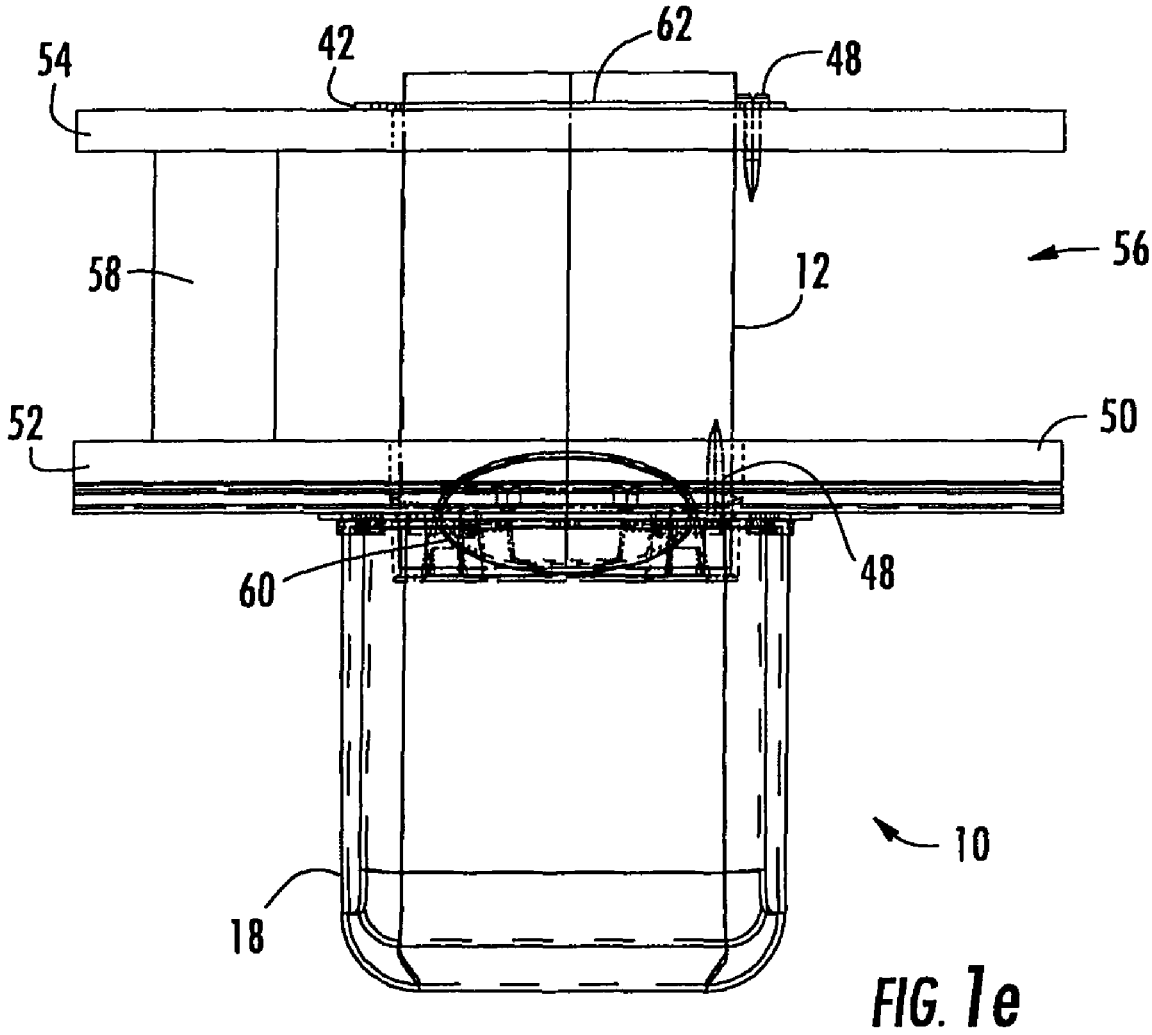
FIG. 1*e* is a top view of the vent assembly of FIG. 1*a* with phantom lines showing components.
Figure 2A:
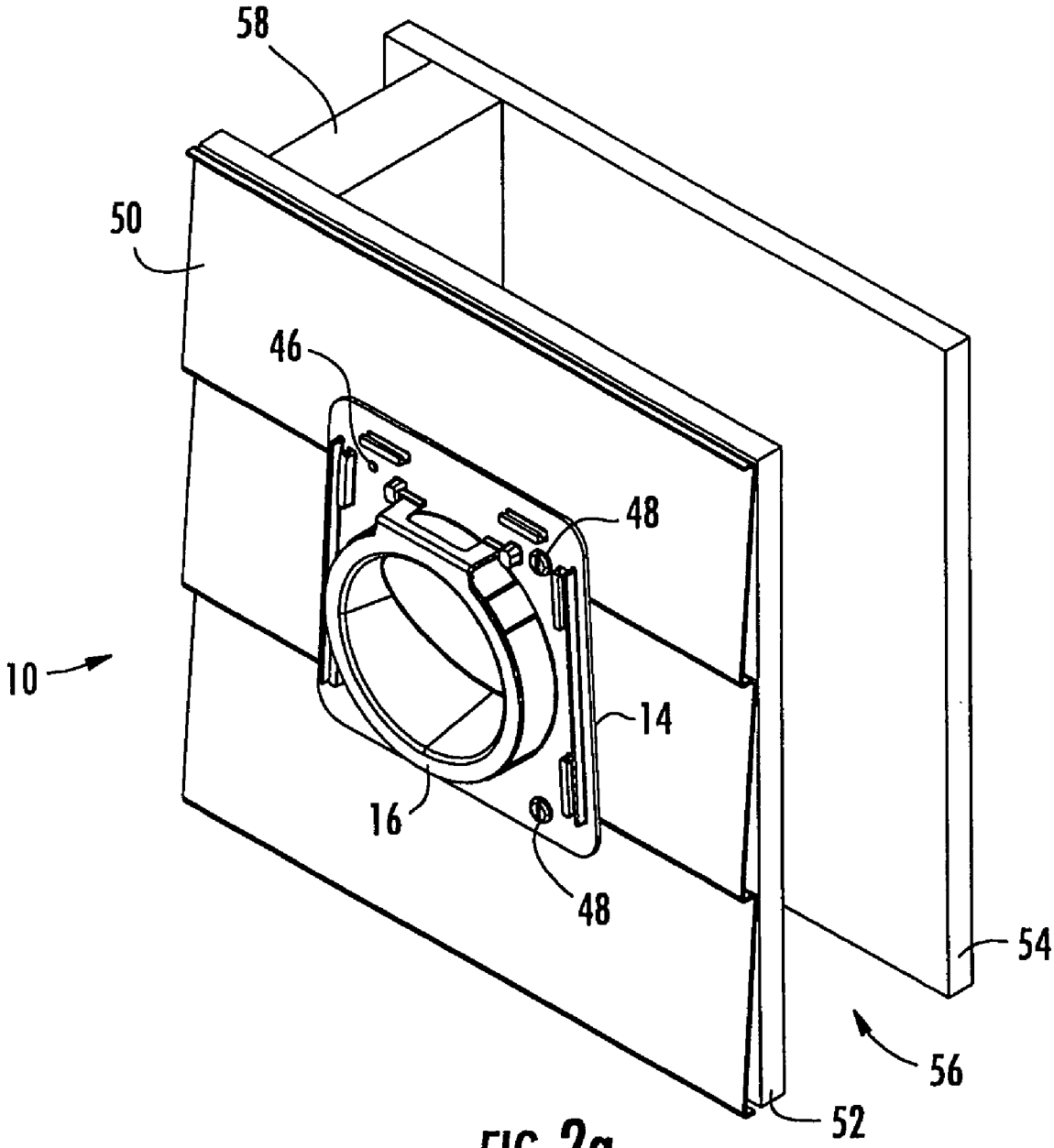
FIG. 2*a* is a top perspective view of the vent assembly of FIG. 1*a* without a hood.
Figure 2B:
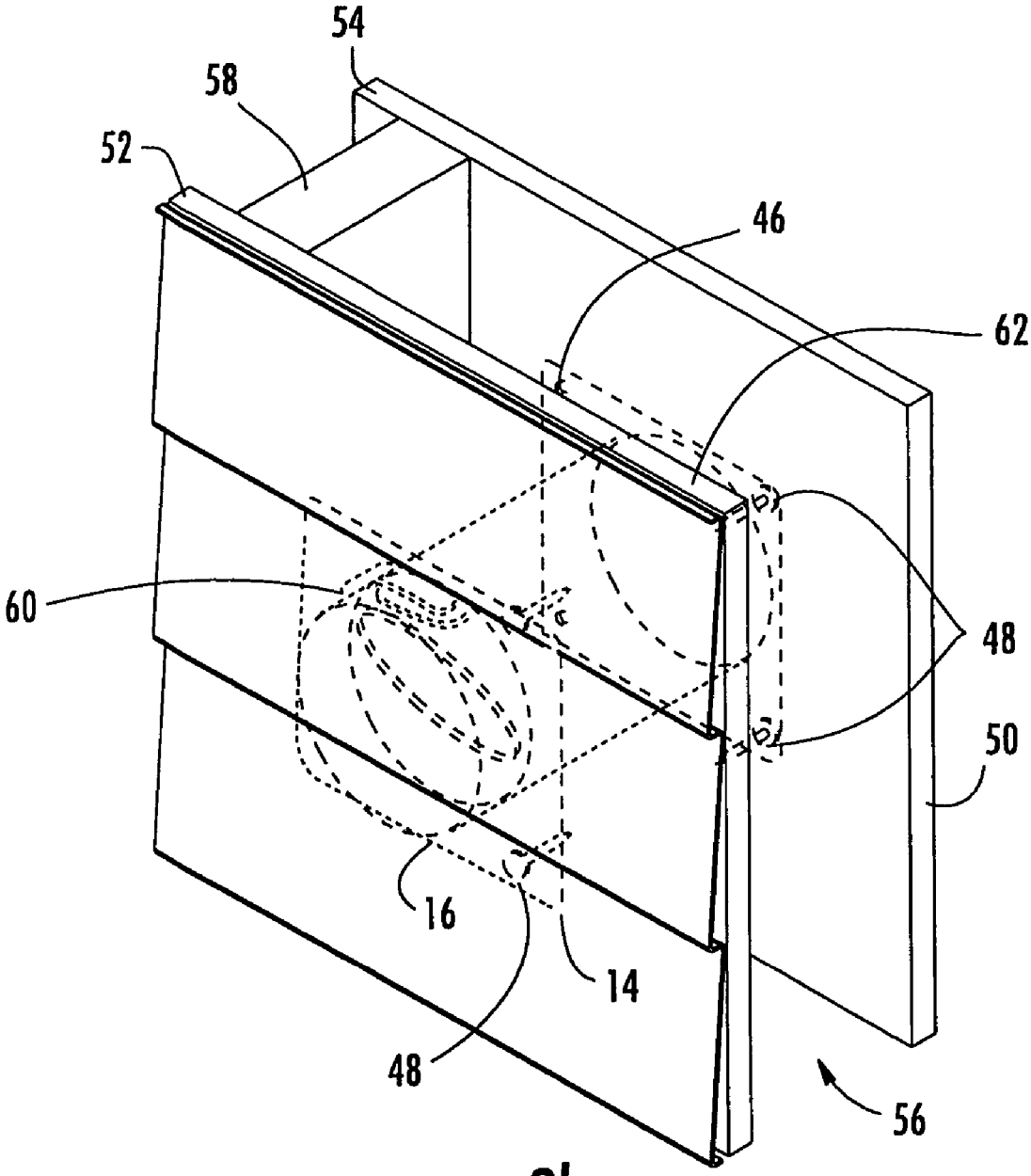
FIG. 2*b* is the vent assembly of FIG. 2*a* with phantom lines showing components.

Referring now to the drawing figures, a bird and small animal restricting vent assembly 10 for use in attachment to a fluid/air discharge conduit 12, such as from a clothes dryer, bathroom fan, kitchen fan, or other fluid/air flow or exhaust passageway according to the present invention is illustrated in FIGS. 1-4. Vent assembly 10 includes a mounting member or mount 14, a door 16, and a hood 18, and is adapted to mount on and engage a fluid discharge conduit 12.

Fluid discharge conduit 12 is received within a building, house, or similar structure 50, as illustrated in FIGS. 1*a*-2*b*. Discharge conduit 12 is typically connected to an exhaust outlet (not shown) from a clothes dryer, a bathroom fan, a kitchen fan, or similar device to discharge air/fluid into the atmosphere outside building 50. Building 50 includes an exterior wall 52, an interior wall 54, and a passage 56 defined between the interior and exterior walls. Passage 56 may accommodate a frame structure 58 of building 50 (illustrated only as a portion of the frame structure), insulation (not shown) and/or utility components (not shown), such as for electricity, water, and the like. Exterior wall 52 includes an exterior aperture 60 aligned with an interior aperture 62 of interior wall 54. Discharge conduit 12 is received within building 50 through interior aperture 62 and exterior aperture 60, with the ends of the discharge conduit protruding from both interior wall 54 and exterior wall 52. Discharge conduit 12 protrudes from exterior wall 52 to receive mount 14 of vent assembly 10. Discharge conduit 12 protrudes from interior wall 54 to receive an interior trim ring 42 and the exhaust outlet from the clothes dryer or similar device. Interior trim ring 42 secures discharge conduit 12 to interior wall 54 and provides an aesthetic cover over interior aperture 62. Discharge conduit 12 includes at the end received by mount 14, a plurality of lanced tube notches 70 or tabs (FIG. 9*a*), preferably four, that snap into corresponding snap notches 68 of the mount, which is discussed further below. Both mount 14 and trim ring 42 include a plurality of screw apertures 46 for receiving bolts or screws 48 therethrough for mounting onto exterior wall 52 and interior wall 54, respectively, as discussed further below. Fasteners 48 received through mount 14 in exterior wall 52 are concealed within and under hood 18 to protect them against the weather and to reduce and/or prevent removal, tampering with or vandalism of the vent assembly from the building exterior.

In the illustrated embodiments, fluid discharge conduit 12 is shown as a 4" sheet metal or polymeric tube with an open end 20. Discharge conduit further includes a plurality of tube notches 70 (FIG. 4), which are received into a plurality of corresponding snap notches 68 of mount 14, as discussed further below to align mount 14 on conduit 12.

Figure 9A:
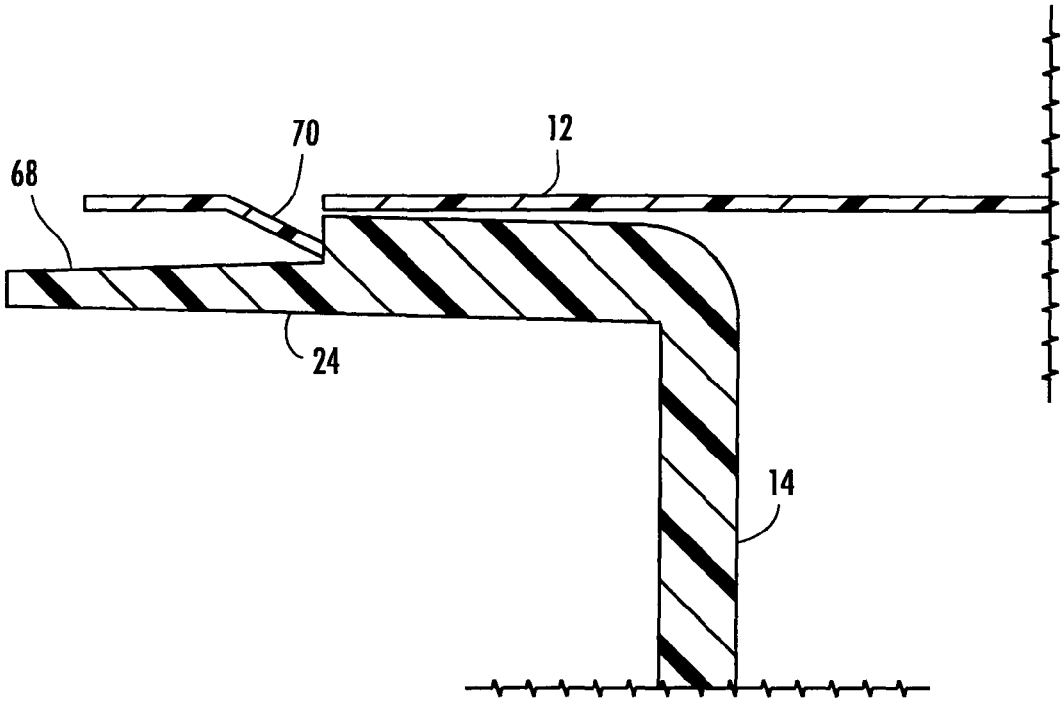
FIG. 9*a* is a sectional side elevation of the tube notch of the discharge conduit snapped into the snap notch of the mount along plane IXa-IXa of FIG. 1*c*.
Figure 9B:
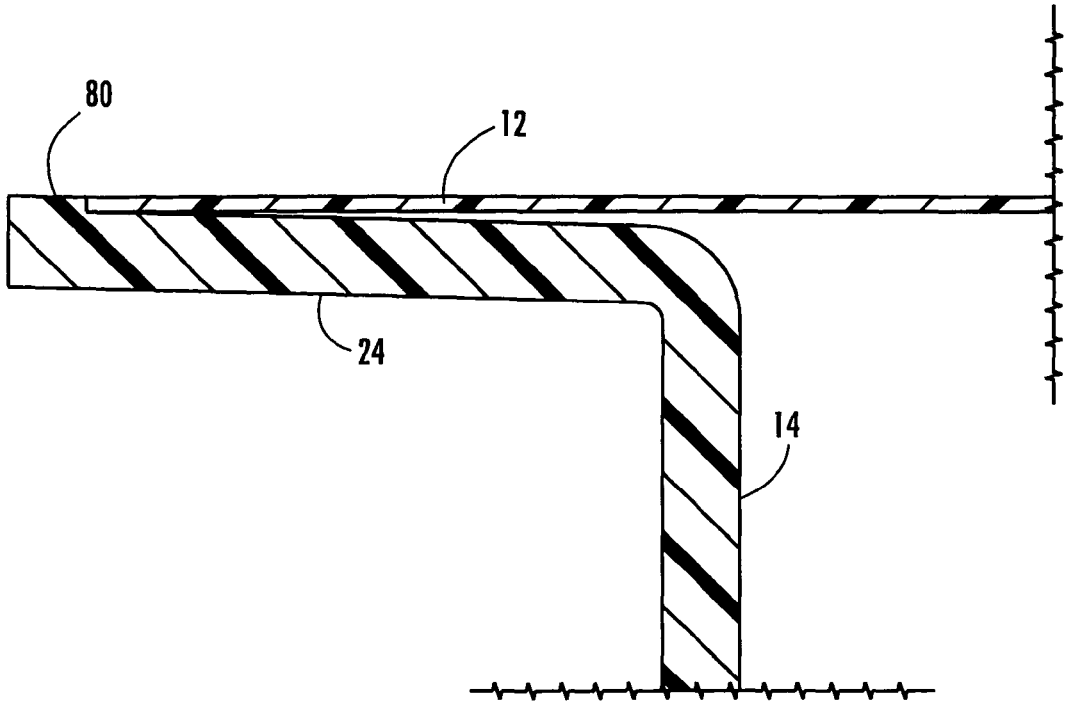
FIG. 9*b* is a sectional side elevation of the end of the discharge conduit engaging the shoulder of the mount along plane IXb-IXb of FIG. 1*c*.

Mounting member or mount 14 is a plate-like structure and includes a generally planar back plate 21 having an opening 22 therethrough as best illustrated in FIGS. 5*a*-5*d*. Opening 22 is received on discharge conduit 12. In the illustrated embodiment of FIGS. 5*a*-5*d*, back plate 21 includes an outwardly extending cylindrical rim surface or rim 24 that defines and outlines opening 22 and protrudes outwardly from the face of mount 14 receiving conduit 12. Rim 24 includes spaced snap notches 68, preferably four, along the perimeter of the inside surface of the rim. Rim 24 also includes a shoulder 80 around the perimeter of the inside surface of the rim in areas between snap notches 68. Snap notches 68 correspond with tube notches 70 of discharge conduit 12. Snap notches 68 receive tube notches 70 as shown in FIG. 9*a* to secure discharge conduit 12 onto mount 14, align mount 14 on the conduit, and limit displacement of the discharge conduit away from the mount while allowing displacement in the other direction. Shoulder 80 receives and abuts the edge of discharge conduit 12 when the conduit is installed onto mount 14, as illustrated in FIG. 9*b*. Shoulder 80 prevents discharge conduit 12 from moving outward from mount 14 after tube notches 70 of the discharge conduit snap into snap notches 68 to secure the discharge conduit onto the mount. Mount 14 further includes a set of latches 26, a plurality of rectilinear guide flanges 28, a plurality of side lipped flanges 29, and a pair of top lipped flanges 31 protruding from generally planar backplate 21 of the mount. Latches 26 are upstanding, aligned, truncated posts, each having an inwardly facing opening 27 adapted to receive the free end of hinge pins 39 of hinge 38 on door 16 as described below.

Figure 8A:
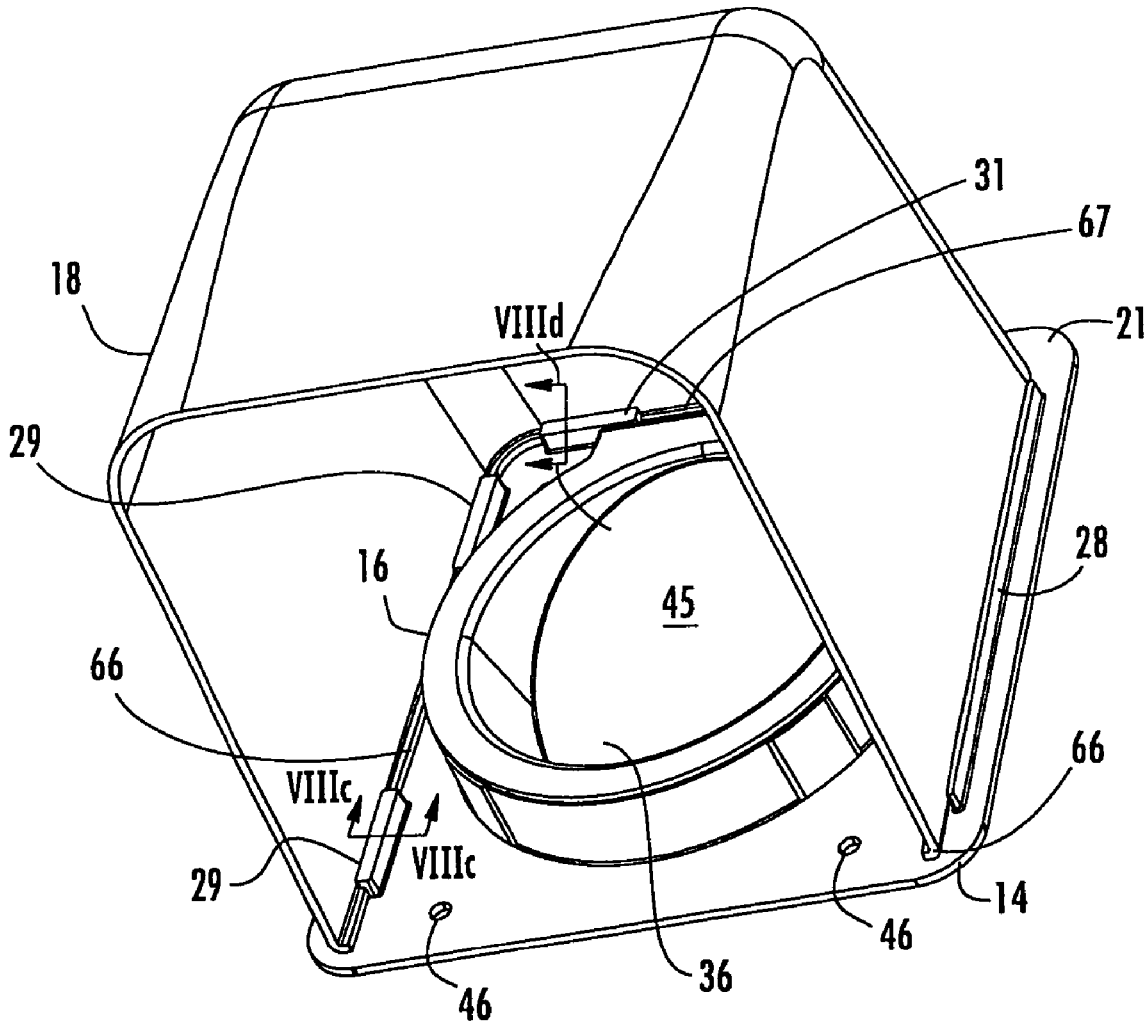
FIG. 8*a* is a bottom perspective view of the vent assembly showing the hood, mount, and door of the present invention.
Figure 8B:
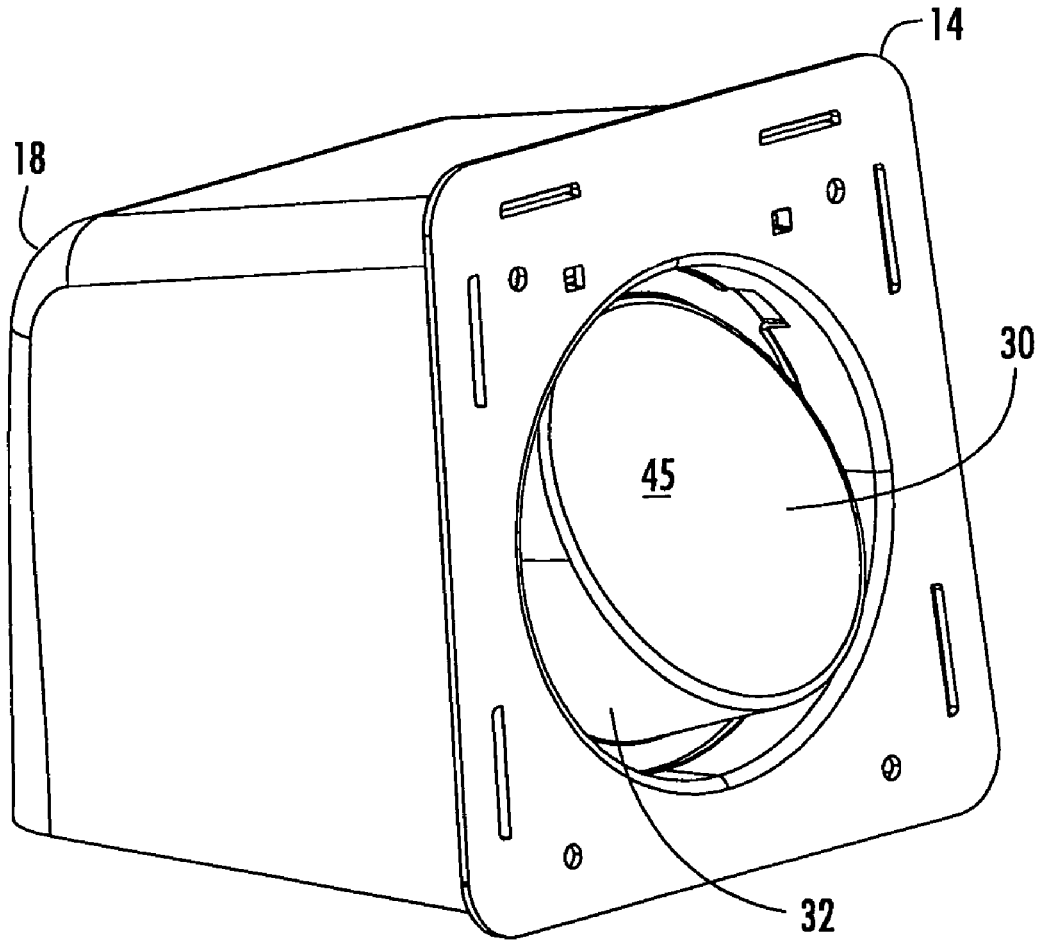
FIG. 8*b* is a rear perspective view of the vent assembly showing the mount and door of the present invention.
Figure 8C:
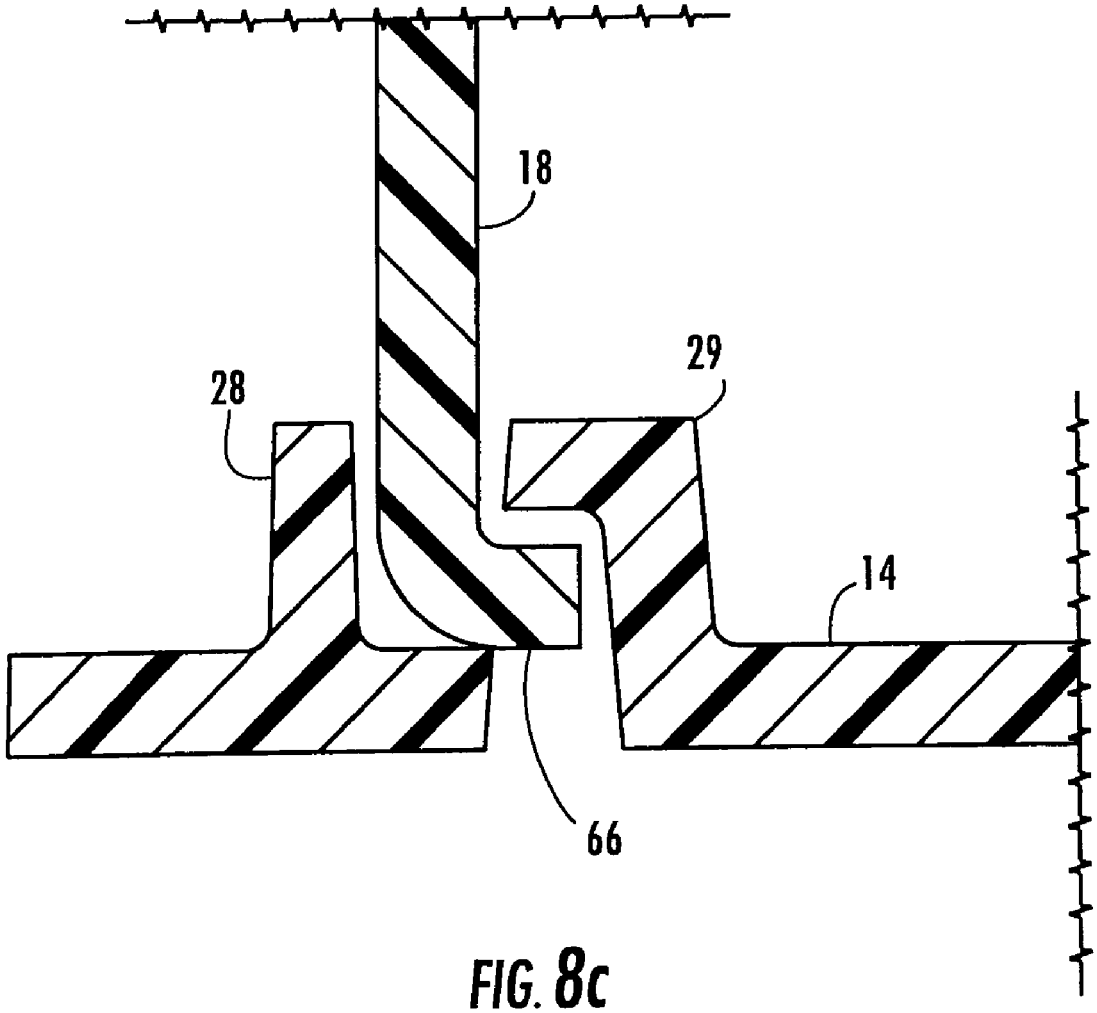
FIG. 8*c* is a sectional side elevation of the hood mounted onto the mount as shown in FIG. 8*a* along plane VIIc-VIIIc of FIG. 8*a;*
Figure 8D:
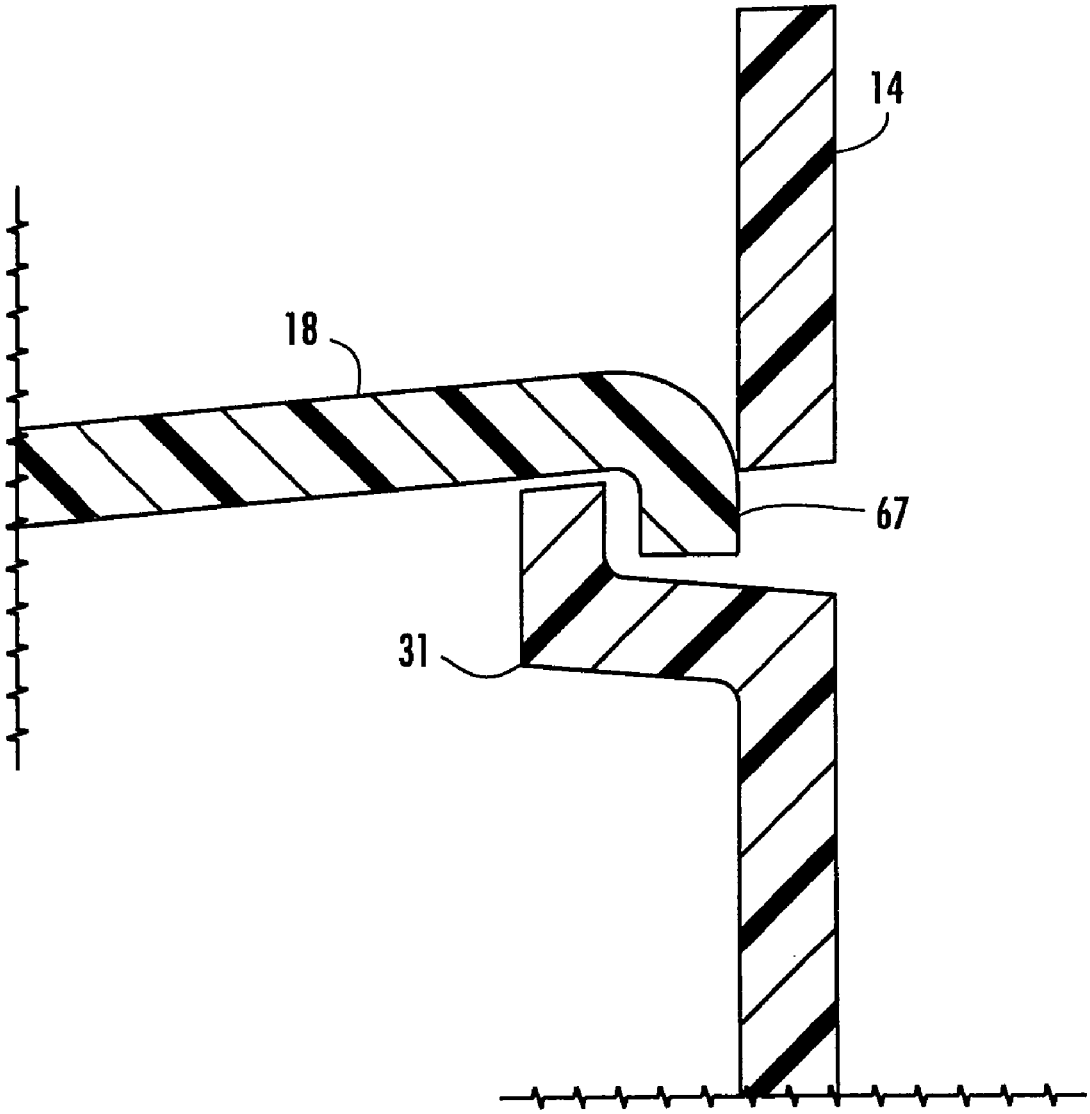
FIG. 8*d* is a sectional side elevation of the hood mounted onto the mount as shown in FIG. 8*a* along plane VIIId-VIIId of FIG. 8*a.*

Guide flanges 28 and side lipped flanges 29 are positioned parallel to and spaced apart from one another adjacent side edges 21*a*, 21*b* of mount 14. A pair of top lipped flanges 31 is aligned with one another adjacent top edge 21*c* of mount 14 and open upwardly. L-shaped lipped edges 66 of hood 18 (FIG. 8*a*) are received at the sides by guide flanges 28 and side lip flanges 29, which are evenly spaced to receive lipped edge 66 (FIG. 8*c*). Similarly, L-shaped lipped top edge 67 (FIG. 8*a*) is received in flange 31 (FIG. 8*d*). When so received, the mating shapes of flanges 29, 31 and 66, 67 restrict outward movement of hood 18 away from back plate 21 of mount 14. Those flanges allow sliding mounting of hood 18 by aligning hood edges 66 with the spaces between flanges 28, 29 at the top of mount 14, followed by downward sliding movement of the hood along guide flanges 28 until hood edge 67 is received in flanges 31. Alternatively, hood edges 66, 67 may be snap fit into flanges 29, 31 by aligning hood 18 with mount 14, as shown in FIGS. 3*a*, 3*b*, 8*a*, and 8*b*, and moving the hood toward mount 14 in a direction generally normal to the plane of back plate 21 until the hood edges engage, snap into, and mate with flanges 29, 31. The resiliency and flexibility of the material of vent assembly 10 such as molded polypropylene facilitates such snap-in action.

As best illustrated in FIGS. 6*a*-6*d*, door 16 includes a first surface portion 30, a second surface portion 32, a generally planar rim or lip 34 extending from the second surface portion and defining circular opening 33 and the circular edge 35 of the door, and a set of coaxial, aligned hinge pins or hinges 38.

Figure 6A:
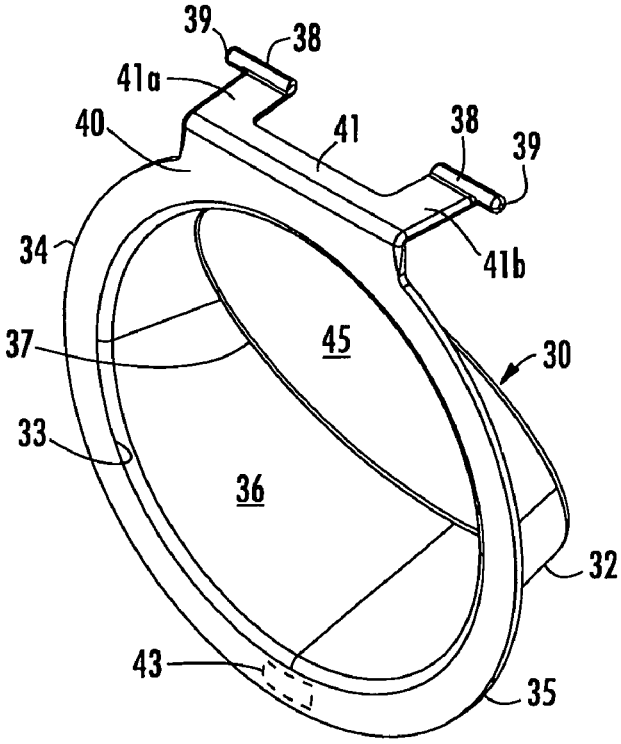
FIG. 6*a* is a top perspective view of the door of the present invention.
Figure 6B:
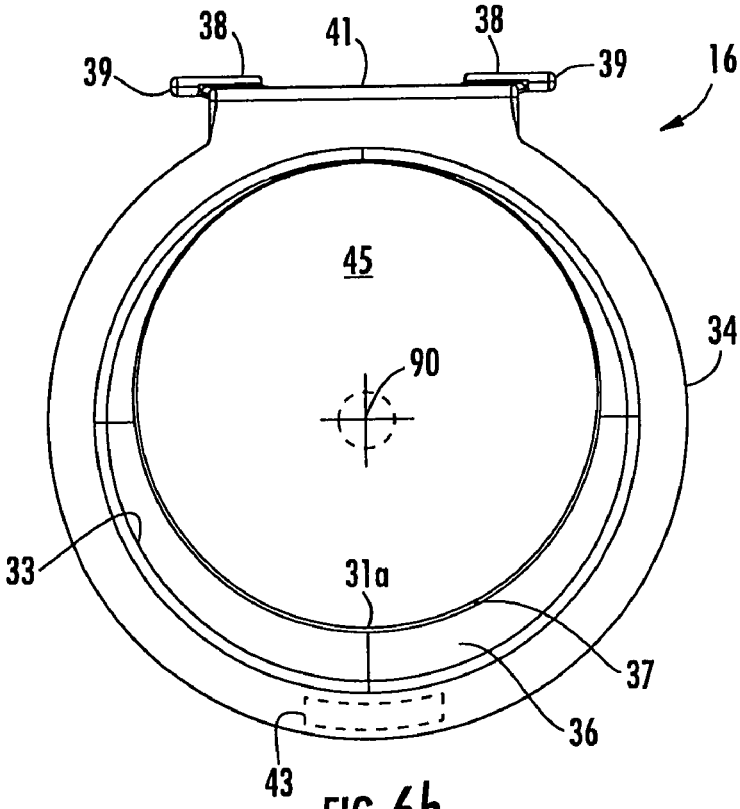
FIG. 6*b* is front view of the door of the present invention.
Figure 6C:
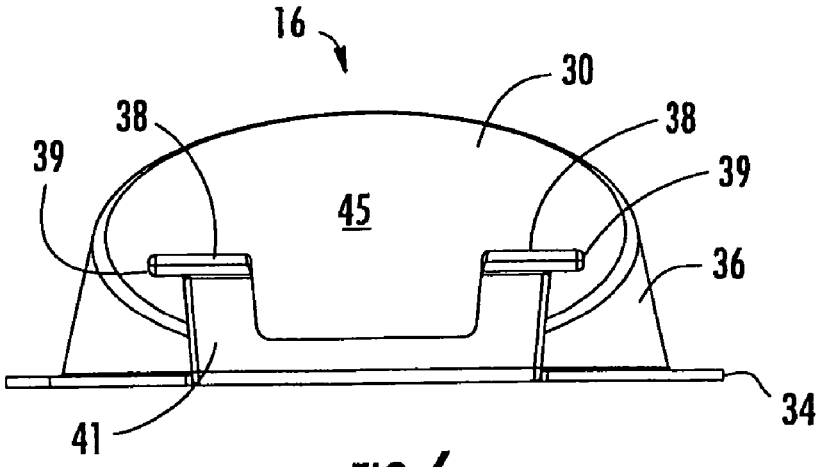
FIG. 6*c* is top view of the door of the present invention.
Figure 6D:
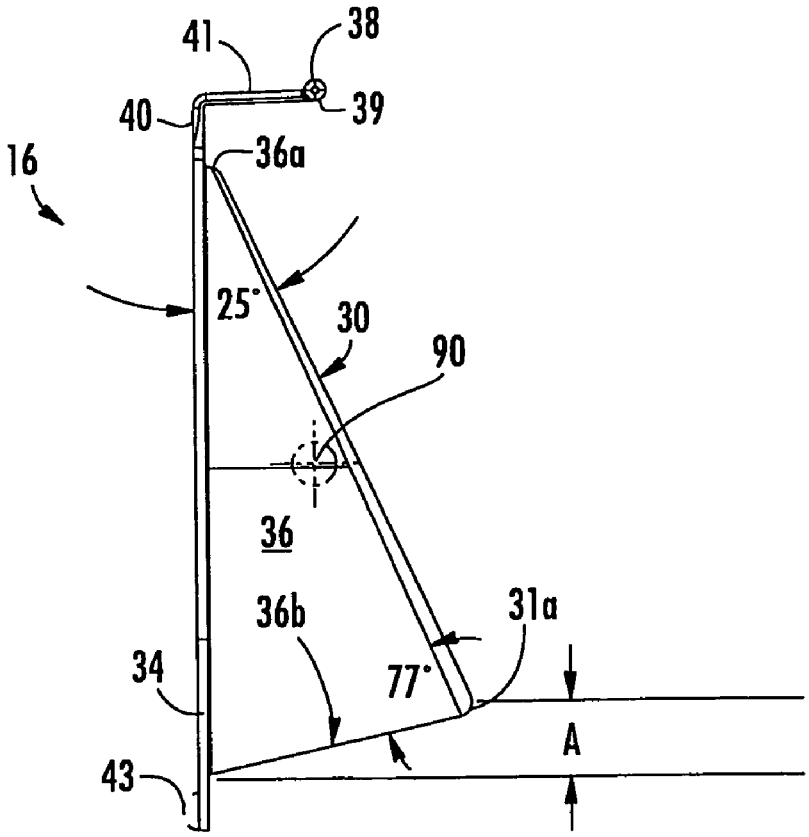
FIG. 6*d* is side view of the door of the present invention.
Figure 7A:
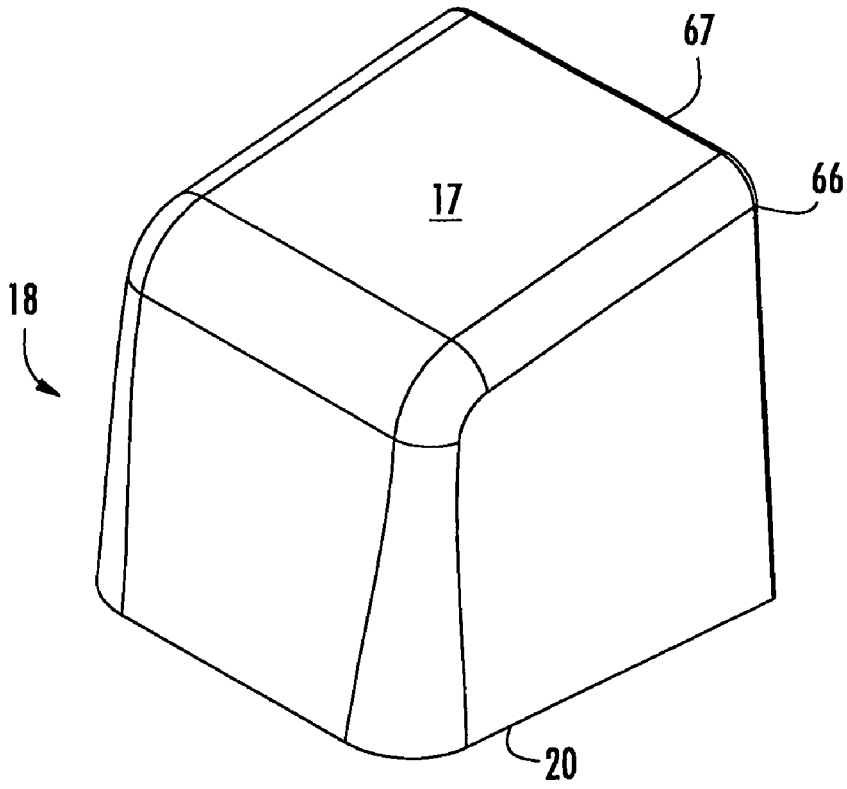
FIG. 7*a* is a top perspective view of the hood of the present invention.
Figure 7B:
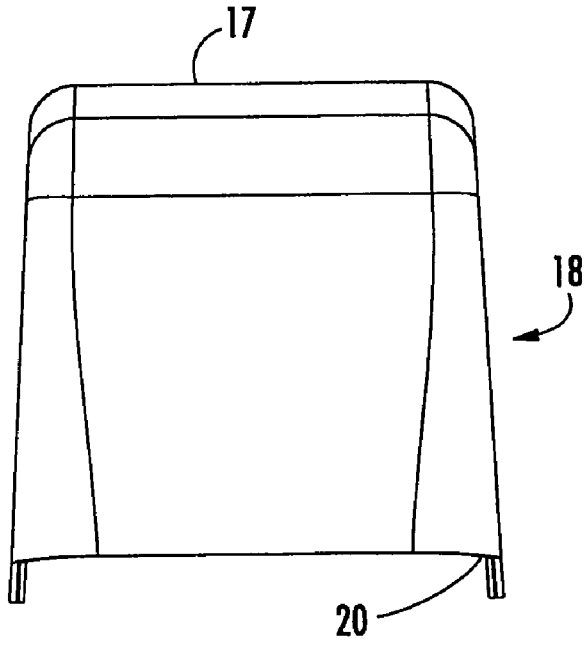
FIG. 7*b* is front view of the hood of the present invention.
Figure 7C:
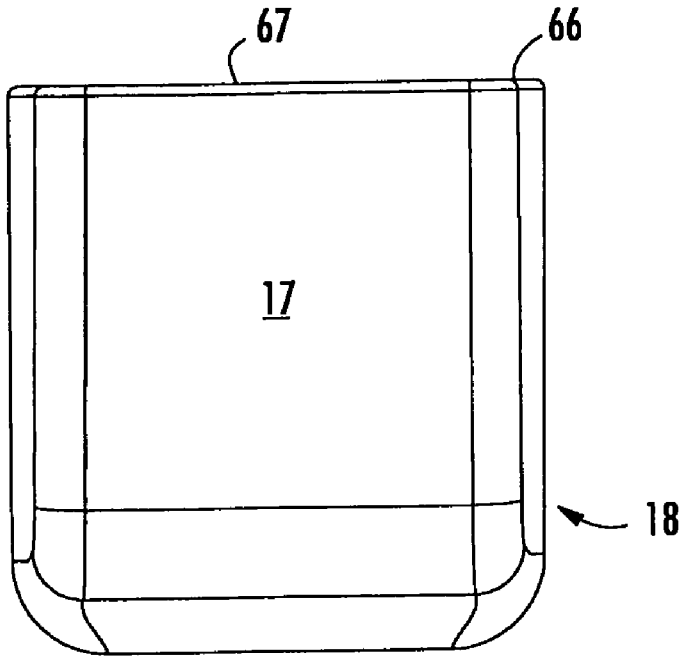
FIG. 7*c* is top view of the hood of the present invention.
Figure 7D:
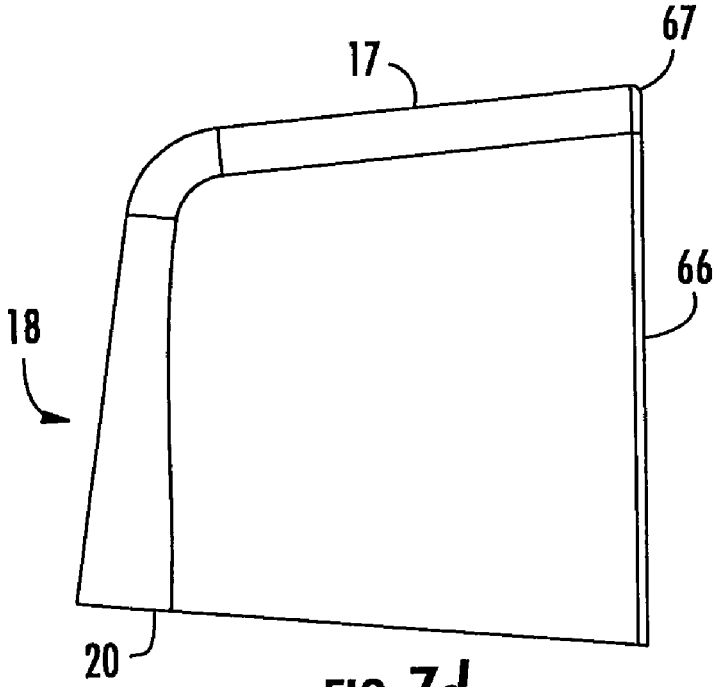
FIG. 7*d* is side view of the hood of the present invention.

First surface portion 30 is a generally planar, circular plate 45 extending inwardly toward conduit 12 at an angle to the plane of rim or lip 34 on the same side of lip 34 on which door mounting flange 40 is formed. Preferably, first surface portion 30 extends at an angle within the range of 15 to 50°, preferably 25°, to the plane of lip 34. At such an angle, the lowermost point 31 a on the circumference of portion 30 is positioned above the lowermost point of opening 33 by a distance A as shown in FIG. 6*d*. Additionally, this angle is such that when fluid is discharged through discharge conduit 12, the fluid/air will effectively contact surface portion 30 so that door 16 will be able to open and effectively discharge the fluid.

First surface 30 may be other than a substantially circular shape, such as an oval or a polygon forming a substantially round shape. Additionally, first surface portion 30 may also have a three-dimensional form that may interact with the discharge of air or fluid from discharge conduit 12 to move door 16 outward to the open position. For example, first surface portion 30 may comprise a dome-like shape or similar three-dimensional form instead of being generally planar, where the three-dimensional shape of the first surface portion merges with second surface portion 32.

Figure 3A:
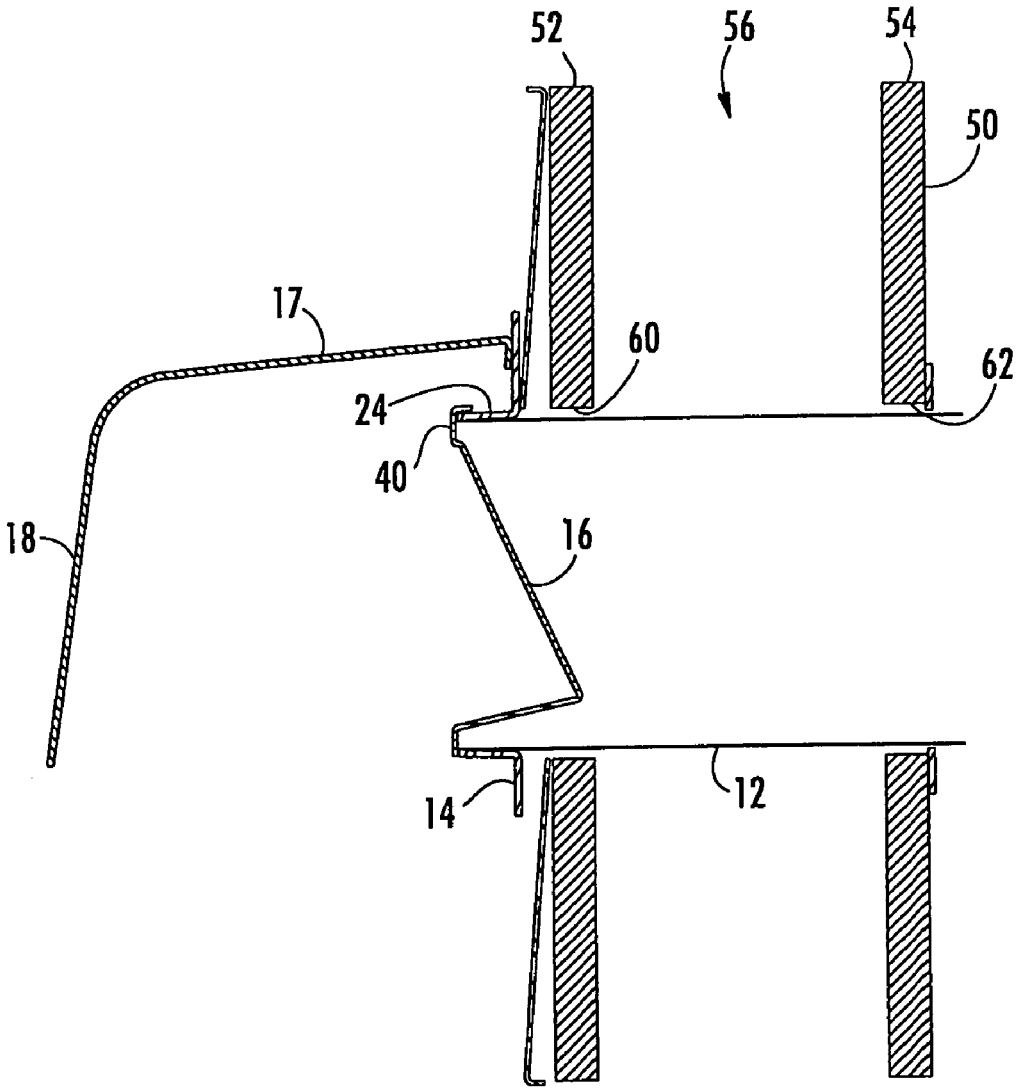
FIG. 3*a* is a sectional side elevation of the vent of FIG. 1*a* in a closed position taken along plane III-III of FIG. 1*c;*

Second surface portion 32 extends from the perimeter of first surface portion 30 and includes a truncated conical wall 36 joined and connected to the outer edge of the first surface portion. Together with lip 34, plate 45 and wall 36 form a solid, fluid impervious closure for conduit 12 when door 16 is in the closed position, as shown in FIG. 3*a*. The top portion of second surface portion 32 includes a short top wall portion 36*a*, as best illustrated in FIG. 6*d*. The height of wall 36 gradually increases on both sides as second surface portion 32 extends to its greatest height at a bottom edge portion 36*b* of the truncated conical wall 36 to form a wedge-like side profile, of significant depth into conduit 12, as illustrated in FIG. 6*d*. Thus second surface portion 32 has the greatest height at bottom edge portion 36*b* of conical wall 36 which is at a position opposite the position at which door 16 is pivotally received on mount 14. First surface portion 30 and bottom edge portion 36*b* of truncated conical wall 36 form an angle with one another as part of the formation of the wedge-like side profile within the range from 40 to 115°, preferably 77°. This angle helps form a relatively deep recessed cavity 37 with first surface portion 30 and second surface portion 32 extending inwardly of discharge conduit 12 to provide an illusion or simulation of thickness of door 16 equal to the height of bottom portion 36*b* of wall 36 when viewed from the side as in FIG. 6*d*. The downward slope of wall portion 36*b* helps prevent debris and other material from collecting within cavity 37 and otherwise restricting operation of the door. Further as door 16 is opened, bottom portion 36*b* of conical wall 36 must move or travel a substantial distance for the bottom portion of the conical wall to pass completely out of the opening, thereby deterring entry of birds or small animals into discharge conduit 12. Thus, door 16 has a maximum thickness defined by the height of bottom portion 36*b* of conical wall 36.

Figure 3B:
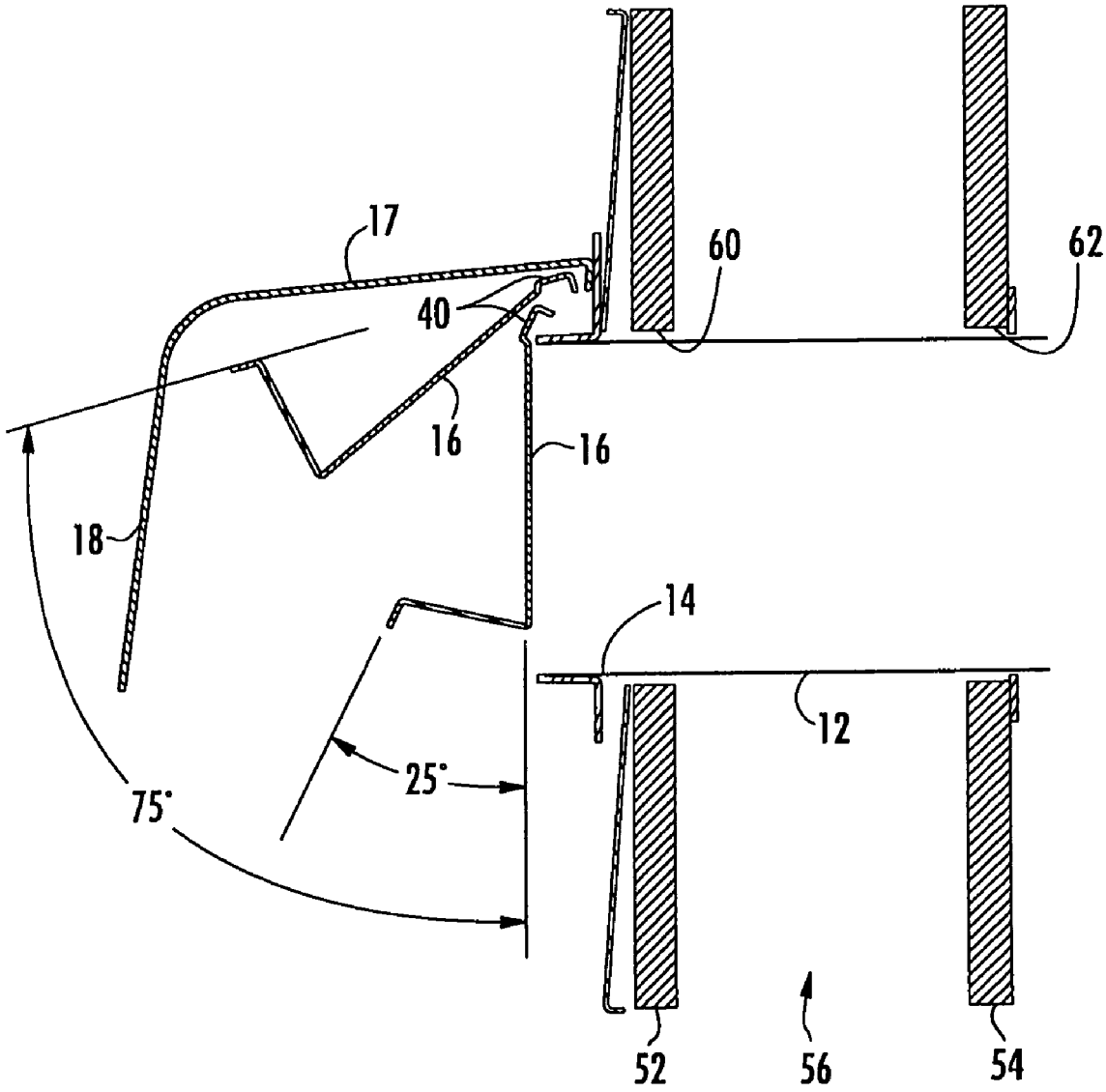
FIG. 3*b* is a sectional side elevation of the vent of FIG. 1*a* in an opened position taken along plane III-III of FIG. 1*c;*
Figure 4:
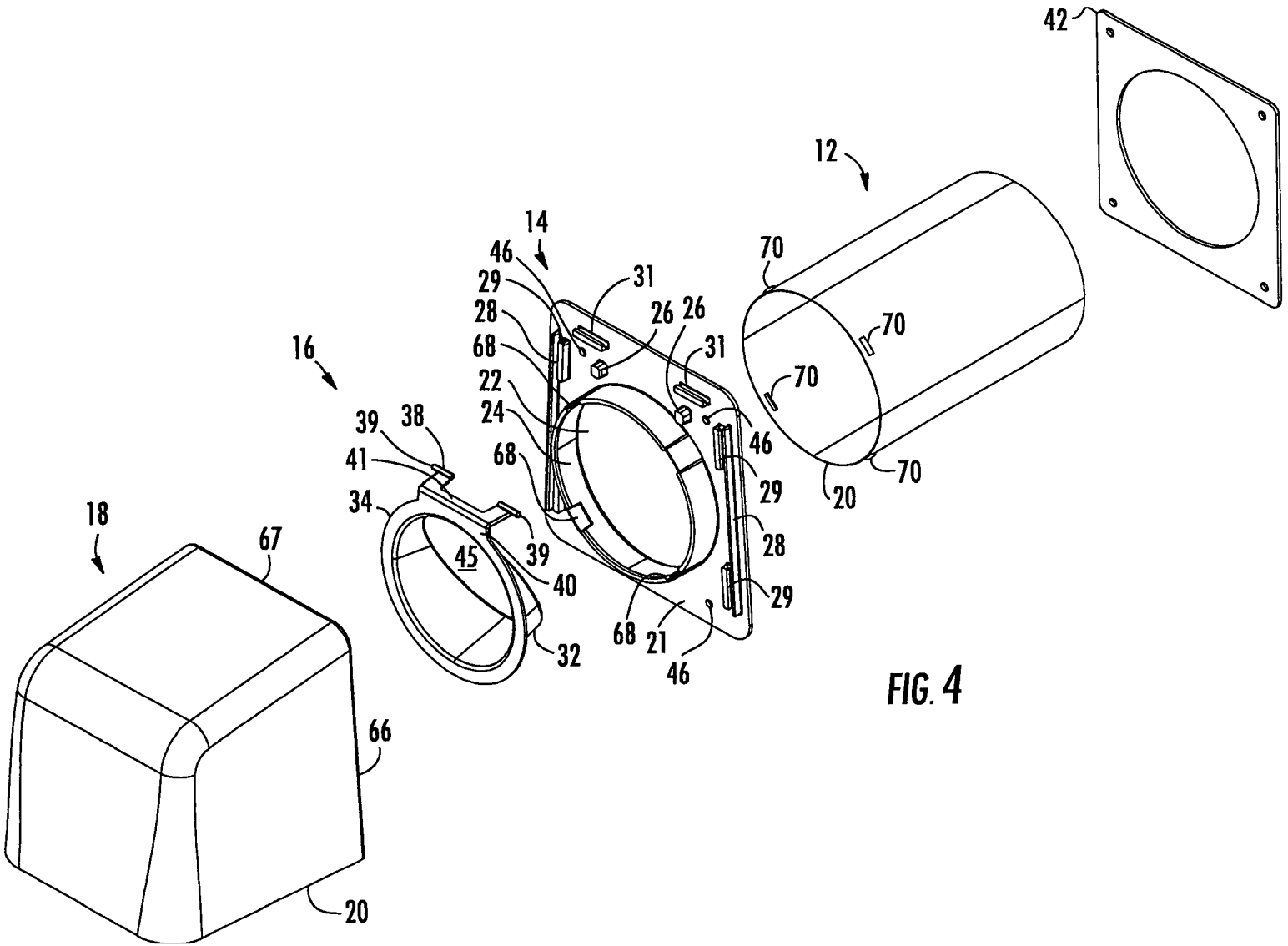
FIG. 4 is an exploded view of the venting system including the vent assembly of the present invention.
Figure 5A:
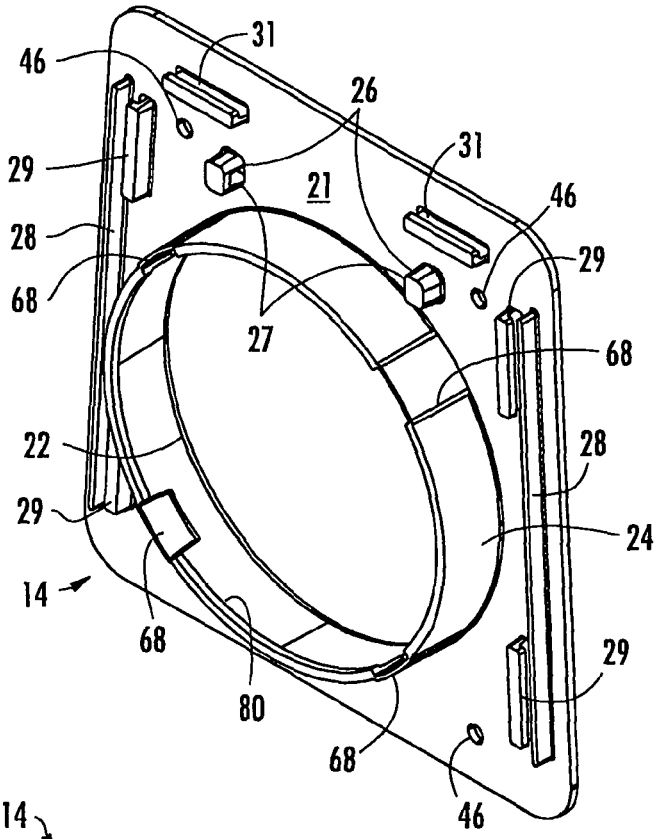
FIG. 5*a* is a top perspective view of the mount of the present invention.
Figure 5B:
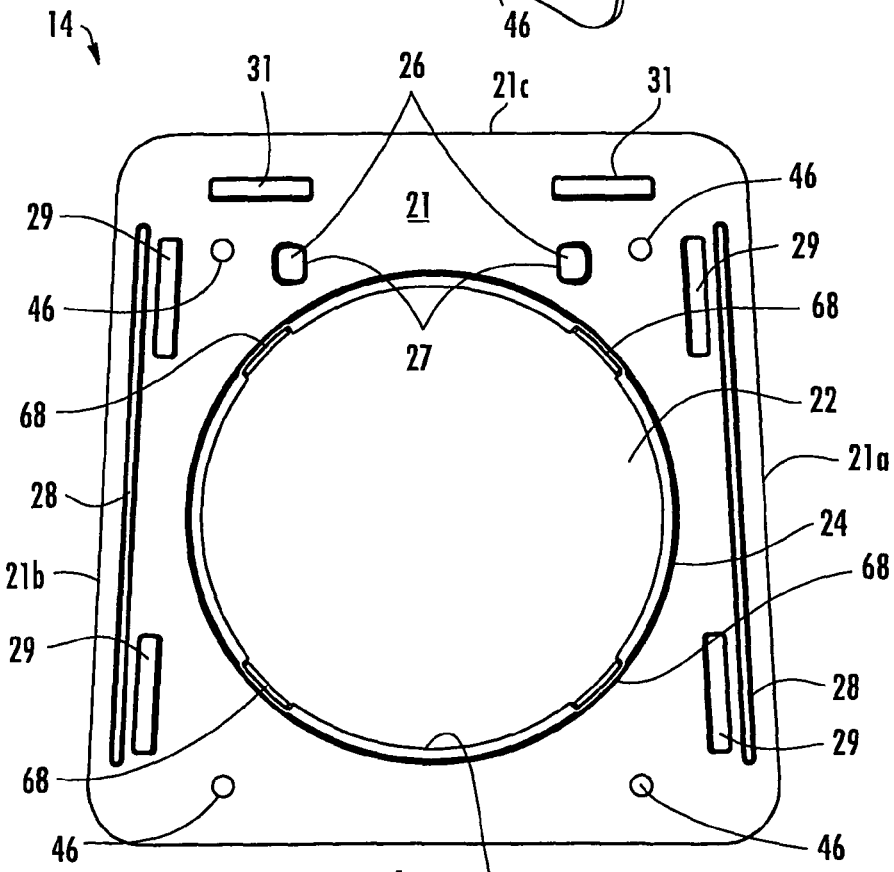
FIG. 5*b* is front view of the mount of the present invention.
Figure 5C:
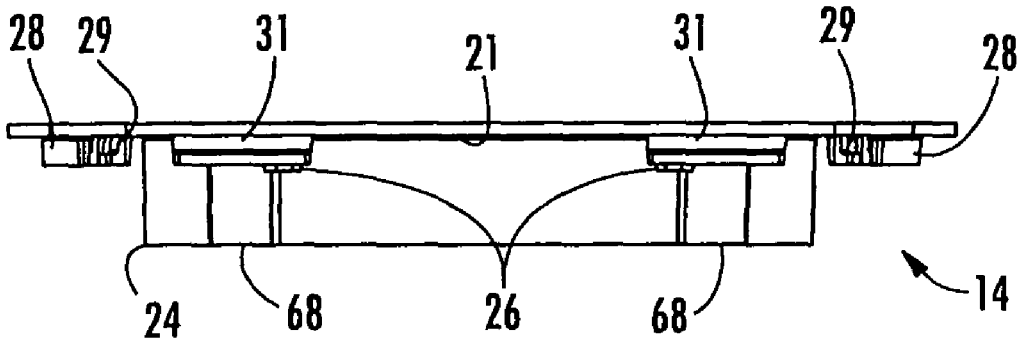
FIG. 5*c* is top view of the mount of the present invention.
Figure 5D:
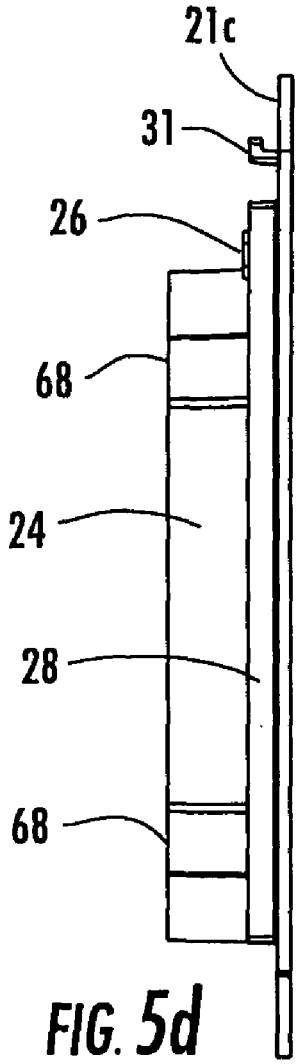
FIG. 5*d* is side view of the mount of the present invention.

As is best seen in FIG. 3*a*, the intersection of the overall cross-sectional area of first and second surface portions 30, 32, with the plane of the edge of lip 24, is slightly less than the overall cross-sectional area of opening 22 and creates a gap or clearance between the circumferences of the opening and the first and second surface portions when the door is in the closed position engaging the lip. The percentage of coverage or intersection of the planar areas of the first and second portions 30, 32 with respect to opening 22, at a plane just inside the lip when door 16 is in the closed position, is in the range of 50% to 99%, but preferably 78%. As door 16 opens, the cross-sectional area of first and second surface portions 30, 32 will intersect the plane of the cross-sectional area of opening 22 for a range of coverage between 50% to 99% with a range of motion of the door from 0° to 50°, but preferably the first and second surface portions are completely out of the opening when the door is at 25°. Thus, as door 16 opens, the cross-sectional area of first and second portions 30, 32 relative to the cross-sectional area of opening 22 will be in a range of 50% to 99% as the door moves within the range of 0° to 50°, preferably 25°, relative to the plane of lip surface and dependent on the angle of the first surface portion relative to the plane of lip 24. This gap or clearance or difference in diameter provides only a small distance between the bottom portion 36*b* of wall 36 and the inside surface of conduit 12 as is shown in FIG. 3*b*. That distance is small enough to deter entry of birds or small animals until door 16 is fully opened. Opening door 16 to that full extent is extremely difficult for birds or small animals. However, when door 16 is pivoted to its fully open position, air/fluid may be freely discharged from discharge conduit 12 with minimal build up of lint or other matter.

First surface 30 may be other than a substantially circular shape, such as an oval or a polygon forming a substantially round disc-like shape. Additionally, first surface portion 30 may also have a three-dimensional form that may interact with the discharge of air or fluid from discharge conduit 12 to move door 16 outward to the open position. For example, first surface portion 30 may comprise a dome-like shape or similar three-dimensional form instead of being generally planar, where the three-dimensional shape of the first surface portion merges with second surface portion 32.

As also shown in FIGS. 6*a*-6*d*, plate 45 and wall 36 define an inwardly extending, recessed cavity 37 having a wedge-like shape when viewed from the side. Door 16 includes upstanding flange 40 formed in the same plane as lip surface 34, and a rearwardly, inwardly extending hinge mounting flange 41, preferably formed at a right angle to flange 40. Hinges 38 are hinge pins 39 formed coaxially with one another at the outer ends of inwardly extending flanges 41*a*, 41*b* of mounting flange 41. Hinge pins 39 include free outer ends received in opening 27 of latches 26 of mount 14, as discussed below. When hood 18 is removed, flange 41 limits the range of movement for opening door 16 to a maximum angle slightly greater than 90°, but preferably 90°, for the plane of lip surface 34 of the door relative to the lip surface. However when hood 18 is received on mount 14, the range of movement for the plane of first surface portion 30 of door 16 relative to the plane of lip surface 34 may be a maximum of 85.5°, but preferably 75°, depending on the angle between the plane of the lip with the first surface portion and/or the angle of a top inside surface 17 of hood 18 relative to the lip, as shown in FIG. 3*b*. The angle of top inside surface 17 prevents further pivotal opening movement by door 16, when hood 18 is received on mount 14. Flange 41 assists in the prevention of chattering of door 16 with mount 14 or hood 18 during fluid discharge from discharge conduit 12 by limiting the range of motion for the door to limit contact with the mount and the hood. The rearward inward extension of flange 41 causes hinges 38 and pins 39 to be offset rearwardly of the plane of lip 34 as shown in FIG. 6*d*, with the offset being in the range of 1% to_50% of the height door 16. The offset of pins 39 rearward to the plane of lip surface 34 positions a center of gravity 90 of door 16, as best illustrated in FIG. 6*d*, substantially aligned underneath pins 39 in the plane of the pins or "hinge plane," such that a forward portion of wall 36 is located forwardly of the center of gravity 90 and the plane of the pins 39, and a rearward portion of wall 36 is located rearwardly of the center of gravity 90 and the plane of the pins 39. Center of gravity 90 location on door 16 urges the door to hang substantially vertically with the plane of lip surface 34 when mount 14 is positioned on conduit 12 with surface 34 substantially vertical and the door closed flush onto the edge of rim 24. Positioning of the center of gravity for door 16 can be adjusted by moving the location of hinges 39 or by adjusting the relative length of flange 41 with respect to the height of the door to ensure effective door closure. Additionally, the rearward inward extension of flange 41 compensates for the height of protruding rim 24 of mount 14.

Plate 45 and wall 36 extend inwardly at sufficient angles to such that they terminate at point 31 a positioned further inwardly within conduit 12 than the plane in which hinges 38 are positioned. Such arrangement positions a significant portion of the weight of door 16 below and inwardly of hinges 38 and helps urge door 16 to its closed position (FIG. 3*a*) when no air flows through conduit 12. To facilitate return of door 16 to its closed position when no air flows through conduit 12, door 16 may also include a weight integrated along the edge of the door. For example, counterweights or perimeter weighting, as shown at 43, in FIGS. 6*a*, 6*b* may be integrated into door 16 at the lowermost portion of lip 34.

Door 16 is balanced to have a neutral position where the plane of rim surface 34 will rest in a substantially vertical orientation to allow for effective closure of opening 22. Thus, the center of gravity of door 16 causes door 16 to hang vertically when hinge pins 39 are received by latches 26. The center of gravity of door 16 is illustrated at FIGS. 6*b* and 6*d*.

Hood 18 is a four-sided structure with L-shaped lipped edges 66, 67 receiving mount 14 and an open end 20 at the bottom of the hood to allow for the discharge of air/fluid from discharge conduit 12, as best illustrated in FIGS. 7*a*-7*d*. L-shaped lipped edges 66, 67 are received by mount 14 by either sliding onto or snapping onto the mount via guide flanges 28, side lipped flanges 29, and top lipped flanges 31, as discussed previously.

Mount 14, door 16, and hood 18 are preferably made from an injection-molded, uniform thickness, durable, polymeric material, such as polypropylene, PVC, or the like. The material resists cracking from incidental impact from lawn sports, maintenance, and the like.

However, the present invention may also be made from other materials, such as aluminum, other sheet metal, or the like. Moreover, the material for door 16 must be light enough to swing open when air or fluid is discharged from discharge conduit 12, but heavy enough to remain in a closed position when there is no discharge of fluid and air from the discharge conduit. Additionally, the material for mount 14 and door 16 may also be painted or injection molded with colors and/or incorporating a UV stabilizer.

Referring to FIGS. 1*a*-1*e* and 4, mount 14 is first received onto conduit 12 which protrudes from structure 50, such as a house, building, or the like. Screw apertures 46 receive corresponding screws 48 through mount 14. Screws 48 are tightened to secure mount 14 onto structure 50 once the mount receives conduit 12 through opening 22. The notches 70 of discharge conduit 12 are received and snapped into snap notches 68 of mount 14 to align mount 14 on the conduit and prevent displacement of the conduit relative to the mount. Hinge pins 39 of hinges 38 of door 16 are received by respective openings 27 of latches 26 of mount 14 for covering opening 22. Hinges 38 pivot freely about latches 26 to allow movement of door 16 into an open position, as shown in FIG. 3*b*, when fluid is discharged from the discharge conduit and to allow the door to return to and remain in a closed position, as shown in FIG. 3*a*, when no such discharge occurs. Lip surface 34 engages rim surface 24 to create a reliable closure of opening 22 in the closed position to eliminate drafts and prevent entry of birds or animals into conduit 12. As discussed earlier, the configuration of the door plate 31 and wall 36 extending rearwardly and inwardly of hinges 38, the position of the center of gravity of the door, and the optional inclusion of counter weighting or perimeter weighting on the door ensure such closure. Door 16 rests substantially flush on rim surface 24 with recessed cavity 37 preferably opening outwardly of opening 22, while plate 31 and wall 36 extend inwardly into conduit 12. However, the present invention also contemplates a configuration for door 16 where recessed cavity 37 opens inwardly of opening 22 (not illustrated).

As air or fluid is discharged from conduit 12, plate 45 defining first surface portion 30, wall 36 defining second surface portion 32, and a circumferential portion of the inside surface of lip 34 are engaged by the moving air/fluid to move the first surface portion as well as wall 36 forming second surface portion 32 and entire door 16 to the open position as shown in FIG. 3*b*. However, door 16 is in the open position only after the door pivots sufficiently to move plate 45 and wall 36 fully out of opening 22, where the plane of lip surface 34 may be anywhere in the range of about 1° to about 50°, but preferably at 25°, as shown in FIG. 3*b*, for door 16 to be in the open position, depending on the angle of first surface portion 30 relative to the plane of lip surface 34. Door 16 must swing a substantial distance, preferably more than 25° (2" in the preferred embodiment when conduit 12 has approximately a 4" diameter), to move the first surface portion 30 and second surface portion 32 fully out of opening 22. The significant distance required to put door 16 in the fully open position makes it difficult for birds, small animals, and the like to fully open the door and gain entrance into opening 22 and conduit 12. When door 16 is moved less than this, wall 36 is sufficiently close to rim 24 of mount 14 to prevent egress into conduit 12. In the preferred embodiment, that distance is a maximum of distance A in FIG. 6*d* and is in the range of 1% to 20%, preferably 12.5%, of the diameter of conduit 12.

In the open position, door 16 allows adequate venting of discharge conduit 12 without the need for a plurality of louvers, guards, or screens that may plug up with lint or other matter. Door 16 of the present invention allows lint and other matter to be freely discharged from venting system 10, while greatly reducing the build up of lint and other matter. Additionally, both door 16 and hood 18 are easily removable from mount 14 for performing cleaning or maintenance. Due to the flexible material characteristics of door 16, pins 39 can be removed by flexing the material of flanges 41*a*, 41*b* and/or bending the pins out of openings 27 of latches 26 of mount 14.

Hood 18 is placed onto mount 14 to protect vent assembly 10 from weather elements such as rain, snow, wind, and the like. Hood 18 may either be slid or snapped on and off mount 14. L-shaped lipped edge 66 of hood 18 may slide in between guide flange 28 and side lipped flange 29 with the lips of the L-shaped lipped edge and the side lipped flange engaging one another as shown in FIGS. 8*c*. The top portion of L-shaped lipped edge 66 engages top lip flange 31 to secure hood 18 onto mount 14 as shown in FIG. 8*d*. Alternatively, L-shaped lipped edge 66 may snap on and off from mount 14 by moving hood 18 with L-shaped lipped edge facing the mount in a direction generally perpendicular to the plane of plate 21 of the mount to engage the L-shaped lipped edge with guide flange 28, side lipped flange 29, and top lipped flange 31. The size of hood 18 allows for lint buildup to fall away automatically, thus reducing the need and requirements for excessive and frequent cleaning and maintenance. Hood 18 is easily removable from mount for allowing access to door 16 or conduit 12, when the door is removed, for cleaning and preventative maintenance. Due to the flexible material characteristics of hood 18, the hood can be easily slide in and out of mount 14. Alternatively, hood 18 can also be easily snapped in and out of mount 14.

While various embodiments of the present invention are described above, it is contemplated that other variations will be developed within the teaching of the present disclosure. Changes and modifications to these specifically described embodiments may be carried out without departing from the principles of the present invention, which is intended to be limited only by the scope of the appended claims as interpreted according to the principles of patent law.

We claim:

1. A vent assembly for attachment to a fluid discharge conduit comprising:

a mount having an opening, said opening adapted to receive the conduit; and a door pivotally received by said mount for covering said opening, said door having a center of gravity and including a first surface portion for covering at least a portion of said opening, a second surface portion for covering another portion of said opening and joined to said first surface portion, a mounting flange coupled to said second surface portion, and a hinge having a rotational axis of said door at said mounting flange;

said first surface portion having forward and rearward portions;

said second surface portion defining a forward plane opposite said first surface portion, said second surface portion extending rearwardly from said forward plane and protruding into said opening, wherein said forward plane is substantially vertical when said door is in a closed position;

said center of gravity of said door located between said forward plane and said first surface portion;

a portion of said mounting flange extending substantially along said forward plane and contacting a front surface of said mount when said door is in the substantially vertical closed position to substantially prevent said door from pivoting inwardly beyond the closed position;

said mounting flange extending rearwardly from said forward plane to space said rotational axis rearwardly from said forward plane a distance such that said rotational axis is positioned rearwardly of said forward portion of said first surface portion and forwardly of said rearward portion of said first surface portion when said door is in the closed position, and to position said hinge directly above or rearwardly of the center of gravity of said door when said door is in the closed position; and wherein said door is operable for displacement with respect to said opening between an open position and said closed position when said door is engaged by fluid flowing through the discharge conduit, said door being in said open position only after said door pivots sufficiently to move said first and second surface portions fully out of said opening, whereby birds, animals, and the like are restricted from entering the conduit.

2. The vent of claim 1 wherein said first and second surface portions form a wedge-like shape, said first surface portion including a planar plate, said second surface portion including a conical wall forming a base of said wedge-like shape, said base being located opposite the position at which said door is pivotally received by said mount.

3. The vent of claim 2 wherein said first and second surface portions form a recessed cavity in said door.

4. The vent of claim 3 wherein said recessed cavity opens outwardly of said opening.

5. The vent of claim 3 wherein said door further includes a lip extending from the edge of said door, said lip engaging said opening in said closed position.

6. The vent of claim 5 wherein said opening includes a rim surface protruding from said mount to receive the conduit, said rim surface receiving and engaging said door in said closed position.

7. The vent of claim 6 wherein said lip rests substantially flush on said rim surface and said first and second surface portions extend into said opening when said door is in said closed position.

8. The vent of claim 3 wherein said door includes a weight to help retain said door in said closed position when no fluid is discharged from the conduit.

9. The vent of claim 1 further comprising a hood received by said mount, said hood covering said door and opening and having an opening for exhausting fluid/air discharged from the conduit.

10. The vent of claim 9 wherein said mount includes a plurality of spaced flanges operable for receiving and securing an edge of said hood.

11. The vent of claim 10 wherein said hood is slidably mounted on said mount.

12. The vent of claim 10 wherein said hood is snap mounted on said mount.

13. The vent of claim 1 wherein said door and said mount comprise a polymeric material having a substantially uniform thickness.

14. A venting system comprising:

a discharge conduit connectable to an air exhaust outlet, said discharge conduit having an open end;

a mount having an opening, said opening received by said discharge conduit; and a door pivotally received by said mount for covering said opening, said door having a center of gravity and including a first surface portion for covering at least a portion of said opening, a second surface portion for covering another portion of said opening and joined to said first surface portion, a mounting flange coupled to said second surface portion, and a hinge at said mounting flange having a rotational axis of said door, said second surface portion defining a forward plane opposite said first surface portion wherein said forward plane is substantially vertical when said door is in a closed position, said second surface portion extending rearwardly from said forward plane and protruding into said opening, said mounting flange extending rearwardly from said forward plane to space said hinge and said rotational axis rearwardly from said forward plane a distance such that said rotational axis is positioned rearwardly of at least a portion of said first surface portion and such that said rotational axis is positioned forwardly of another portion of said first surface portion when said door is in the closed position, and to position said rotational axis directly above or rearwardly of the center of gravity of said door when said door is in the closed position;

a portion of said mounting flange extending substantially along said forward plane and contacting a front surface of said mount when said door is in the substantially vertical closed position to substantially prevent said door from pivoting inwardly beyond the closed position; and wherein said door is pivotable for displacement with respect to said opening between an open position and said closed position when said door is engaged by fluid flowing through said discharge conduit, said door being in said open position only after said door pivots sufficiently to move said first and second surface portions fully out of said opening, whereby birds, animals, and the like are restricted from entering the conduit.

15. The venting system of claim 14 wherein said first and second surface portions form a wedge-like shape, said first surface portion including a planar plate, said second surface portion including a conical wall forming the base of said wedge like shape, said base of said wedge-like shape being located opposite the position at which said door is pivotally received by said mount.

16. The venting system of claim 15 wherein said first and second surface portions form a recessed cavity in said door.

17. The venting system of claim 16 wherein said recessed cavity opens outwardly of said opening.

18. The venting system of claim 16 wherein said door further includes a lip extending from the edge of said door, said lip engaging said opening in said closed position.

19. The venting system of claim 18 wherein said opening includes a rim surface protruding from said mount to receive the conduit, said rim surface receiving and engaging said door in said closed position.

20. The venting system of claim 19 wherein said lip rests substantially flush on said rim surface and said first and second surface portions extend into said opening when said door is in said closed position.

21. The venting system of claim 20 wherein said door includes a weight to help retain said door in said closed position when no fluid is discharged from the conduit.

22. The venting system of claim 14 further comprising a hood received by said mount, said hood covering said door and opening and having an opening for exhausting fluid/air discharged from the conduit.

23. The venting system of claim 14 wherein said door and said mount comprise a polymeric material having a substantially uniform thickness.

* * * * *

UNITED STATES PATENT AND TRADEMARK OFFICE

CERTIFICATE OF CORRECTION

PATENT NO. : 7,988,544 B2
APPLICATION NO. : 11/477845
DATED : August 2, 2011
INVENTOR(S) : Vanden Bosch et al.

It is certified that error appears in the above-identified patent and that said Letters Patent is hereby corrected as shown below:

Column 4
Line 61, "VIIc" should be "VIIIc"

Column 6
Line 66, Insert --disc-like-- after "round"

Column 8
Line 6, Delete the paragraph beginning with "First Surface" and insert
--First surface portion 30 and second surface portion 32 continue to substantially cover opening 22 as door 16 is opened as shown in FIGS. 3a, 3b. The percentage of coverage by the first and second surface portions 30, 32 and lip surface 34 is in a range from 99% and 50% as the door is opened in the range of 0 to 50. This substantial coverage of opening 22 for the range of door 16 opening deters the entry of birds or small animals. Door 16 is in the open position when first and second surface portions 30, 32 are completely out of opening 22 and the door is opened within the range between 15 and 90, preferably 25 and beyond.--

Column 8
Line 45, delete "___" before 50%

Signed and Sealed this
Twelfth Day of March, 2013

Teresa Stanek Rea
*Acting Director of the United States Patent and Trademark Office*